US007753023B2

(12) United States Patent
Takami et al.

(10) Patent No.: US 7,753,023 B2
(45) Date of Patent: Jul. 13, 2010

(54) CYLINDER LINER AND METHOD FOR MANUFACTURING THE SAME

(75) Inventors: Toshihiro Takami, Toyota (JP); Kouhei Hori, Aichi-ken (JP); Takeshi Tsukahara, Toyota (JP); Noritaka Miyamoto, Toyota (JP); Masaki Hirano, Toyota (JP); Yukinori Ohta, Nagoya (JP); Satoshi Yamada, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/480,874

(22) Filed: Jul. 6, 2006

(65) Prior Publication Data

US 2007/0012176 A1 Jan. 18, 2007

(30) Foreign Application Priority Data

Jul. 8, 2005 (JP) ..... 2005-200999

(51) Int. Cl.
*F02F 1/00* (2006.01)
*F02F 1/10* (2006.01)

(52) U.S. Cl. ..... 123/193.2; 123/669; 123/270; 123/271; 123/41.84; 123/272

(58) Field of Classification Search ..... 29/888.061; 123/41.69, 193, 193.2, 669, 668, 41.84, 270, 123/271, 272; 138/147; 184/18; 384/13; 92/153, 169.1, 171.1; *F02F 1/00, 1/10*
See application file for complete search history.

(56) References Cited

U.S. PATENT DOCUMENTS

| | | | | | |
|---|---|---|---|---|---|
| 1,955,292 | A | * | 4/1934 | Heintz | 29/888.061 |
| 2,085,976 | A | * | 7/1937 | Heintz | 92/153 |
| 3,903,951 | A | * | 9/1975 | Kaneko et al. | 164/97 |
| 4,273,835 | A | * | 6/1981 | Higuchi | 428/446 |
| 4,486,938 | A | * | 12/1984 | Hext | 29/402.06 |
| 4,930,546 | A | | 6/1990 | Kawamura et al. | |
| 5,134,264 | A | * | 7/1992 | Burger et al. | 219/644 |

(Continued)

FOREIGN PATENT DOCUMENTS

DE 197 45 585 4/1998

(Continued)

OTHER PUBLICATIONS

International Search Report, PCT/JP2006/313923 dated Jul. 11, 2006.

(Continued)

*Primary Examiner*—Stephen K Cronin
*Assistant Examiner*—Keith Coleman
(74) *Attorney, Agent, or Firm*—Kenyon & Kenyon LLP

(57) ABSTRACT

A cylinder liner has an outer circumferential surface on which a film is formed. The film functions to form gaps between the cylinder block and the cylinder liner. Alternatively, the film functions to reduce adhesion of the cylinder liner to the cylinder block. The cylinder liner suppresses excessive decreases in the temperature of a cylinder.

27 Claims, 18 Drawing Sheets

U.S. PATENT DOCUMENTS

| | | | | |
|---|---|---|---|---|
| 5,148,780 | A | 9/1992 | Urano et al. | |
| 5,320,761 | A * | 6/1994 | Hoult et al. | 508/110 |
| 5,537,969 | A * | 7/1996 | Hata et al. | 123/193.2 |
| 5,671,532 | A * | 9/1997 | Rao et al. | 29/888.061 |
| 6,138,630 | A * | 10/2000 | Lazcano-Navarro | 123/193.2 |
| 6,167,847 | B1 * | 1/2001 | Ergezen et al. | 123/41.79 |
| 6,286,583 | B1 | 9/2001 | Rueckert et al. | |
| 6,736,101 | B2 * | 5/2004 | Kano et al. | 123/193.2 |
| 2002/0033161 | A1 | 3/2002 | Hoffmann et al. | |
| 2003/0168197 | A1 | 9/2003 | Miyamoto et al. | |

FOREIGN PATENT DOCUMENTS

| | | | |
|---|---|---|---|
| DE | 199 37 934 | A | 2/2001 |
| DE | 100 02 440 | A1 | 8/2001 |
| DE | 101 03 459 | A | 9/2001 |
| DE | 103 38 386 | B3 | 12/2004 |
| DE | 103 47 510 | B3 | 4/2005 |
| EP | 1 504 833 | A1 | 2/2005 |
| JP | 53-135839 | | 11/1978 |
| JP | 60-58824 | | 4/1985 |
| JP | 62-52255 | | 3/1987 |
| JP | 2001-200751 | A | 7/2001 |
| JP | 2003-53508 | | 2/2003 |
| JP | 2003-120414 | A | 4/2003 |
| JP | 2003-326346 | A | 11/2003 |
| JP | 2003-326353 | A | 11/2003 |
| JP | 2004-082192 | A | 3/2004 |
| RU | 2 236 608 | C2 | 9/2004 |
| WO | WO 01/58621 | A1 | 8/2001 |

OTHER PUBLICATIONS

Written Opinion of the International Searching Authority, PCT/JP2006/313923.

* cited by examiner

| Basic Component | |
|---|---|
| T.C | 2.9 (% by mass) ~ 3.7 (% by mass) |
| Si | 1.6 (% by mass) ~ 2.8 (% by mass) |
| Mn | 0.5 (% by mass) ~ 1.0 (% by mass) |
| P | 0.05 (% by mass) ~ 0.4 (% by mass) |

| Auxiliary Component | |
|---|---|
| Cr | 0.05 (% by mass) ~ 0.4 (% by mass) |
| B | 0.03 (% by mass) ~ 0.08 (% by mass) |
| Cu | 0.3 (% by mass) ~ 0.5 (% by mass) |

* T.C represents Total Carbon

Irradiation of Laser Light

Placement of Test Piece

Spraying of First Layer

Spraying of Second and Subsequent Layers

CYLINDER LINER AND METHOD FOR MANUFACTURING THE SAME

BACKGROUND OF THE INVENTION

The present invention relates to a cylinder liner of an engine.

Cylinder blocks for engines with cylinder liners have been put to practical use. As such a cylinder liner, the one disclosed in Japanese Laid-Open Utility Model Publication No. 53-163405 is known.

Recent environmental concerns have created a demand for an improved fuel consumption rate of engines. On the other hand, it has been found out that, if the temperature of a cylinder significantly falls below an appropriate temperature at some locations during operation of an engine, the viscosity of the engine oil about those locations will be excessively high. This increases the friction and thus degrades the fuel consumption rate. Such deterioration of the fuel consumption rate due to the cylinder temperature is particularly noticeable in engines in which the thermal conductivity of the cylinder block is relatively great (for example, an engine made of an aluminum alloy).

SUMMARY OF THE INVENTION

Accordingly, it is an objective of the present invention to provide a cylinder liner and a method for manufacturing the same that suppresses excessive decreases in the temperature of a cylinder.

To achieve the foregoing objectives and in accordance with a first aspect of the present invention, a cylinder liner for insert casting used in a cylinder block is provided. This cylinder liner includes an outer circumferential surface on which a film is formed. This film functions to form gaps between the cylinder block and the cylinder liner.

In accordance with a second aspect of the present invention, a cylinder liner for insert casting used in a cylinder block is provided. This cylinder liner includes an outer circumferential surface on which a film is formed. This film functions to reduce adhesion of the cylinder liner to the cylinder block.

In accordance with a third aspect of the present invention, a cylinder liner for insert casting used in a cylinder block is provided. This cylinder liner includes an outer circumferential surface on which a film is formed. This film is made of a mold release agent for die casting.

In accordance with a fourth aspect of the present invention, a cylinder liner for insert casting used in a cylinder block is provided. This cylinder liner includes an outer circumferential surface on which a film is formed. This film is made of a mold wash for centrifugal casting.

In accordance with a fifth aspect of the present invention, a cylinder liner for insert casting used in a cylinder block is provided. This cylinder liner includes an outer circumferential surface on which a film is formed. This film is made of a low adhesion agent containing graphite as a major component.

In accordance with a sixth aspect of the present invention, a cylinder liner for insert casting used in a cylinder block is provided. This cylinder liner includes an outer circumferential surface on which a film is formed. This film is made of a low adhesion agent containing boron nitride as a major component.

In accordance with a seventh aspect of the present invention, a cylinder liner for insert casting used in a cylinder block is provided. This cylinder liner includes an outer circumferential surface on which a film is formed. This film is made of a metallic paint.

In accordance with an eighth aspect of the present invention, a cylinder liner for insert casting used in a cylinder block is provided. This cylinder liner includes an outer circumferential surface on which a film is formed, the film being made of a high-temperature resin.

In accordance with a ninth aspect of the present invention, a cylinder liner for insert casting used in a cylinder block is provided. This cylinder liner includes an outer circumferential surface on which a film is formed. This film is made of a chemical conversion treatment layer.

In accordance with a tenth aspect of the present invention, a cylinder liner for insert casting used in a cylinder block is provided. This cylinder liner includes an outer circumferential surface on which a film is formed. This film is formed of an oxide layer.

In accordance with an eleventh aspect of the present invention, a cylinder liner for insert casting used in a cylinder block is provided. This cylinder liner includes an outer circumferential surface on which a film is formed. This film is formed of a sprayed layer made of an iron-based material. The sprayed layer includes a plurality of layers.

In accordance with a twelfth aspect of the present invention, a cylinder liner for insert casting used in a cylinder block is provided. This cylinder liner includes an outer circumferential surface having a plurality of projections. Each projection has a constricted shape. A film is formed on the outer circumferential surface. This film has a thermal conductivity lower than that of at least one of the cylinder block and the cylinder liner.

In accordance with a thirteenth aspect of the present invention, a cylinder liner for insert casting used in a cylinder block is provided. This cylinder liner includes an outer circumferential surface extending from a middle portion to a lower end of the cylinder liner with respect to an axial direction of the cylinder liner. A film is formed on the outer circumferential surface. This film has a thermal conductivity lower than that of at least one of the cylinder block and the cylinder liner.

In accordance with a fourteenth aspect of the present invention, a method for manufacturing a cylinder liner for insert casting used in a cylinder block is provided. This method includes heating the cylinder liner, thereby forming a film on an outer circumferential surface of the cylinder liner, the film being formed of an oxide layer.

In accordance with a fifteenth aspect of the present invention, a method for manufacturing a cylinder liner for insert casting used in a cylinder block is provided. This method includes forming a film on an outer circumferential surface of the cylinder liner by arc spraying in which a spray wire the diameter of which is equal to or more than 0.8 mm is used.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 18C.

Structure of Engine

Figure 1:
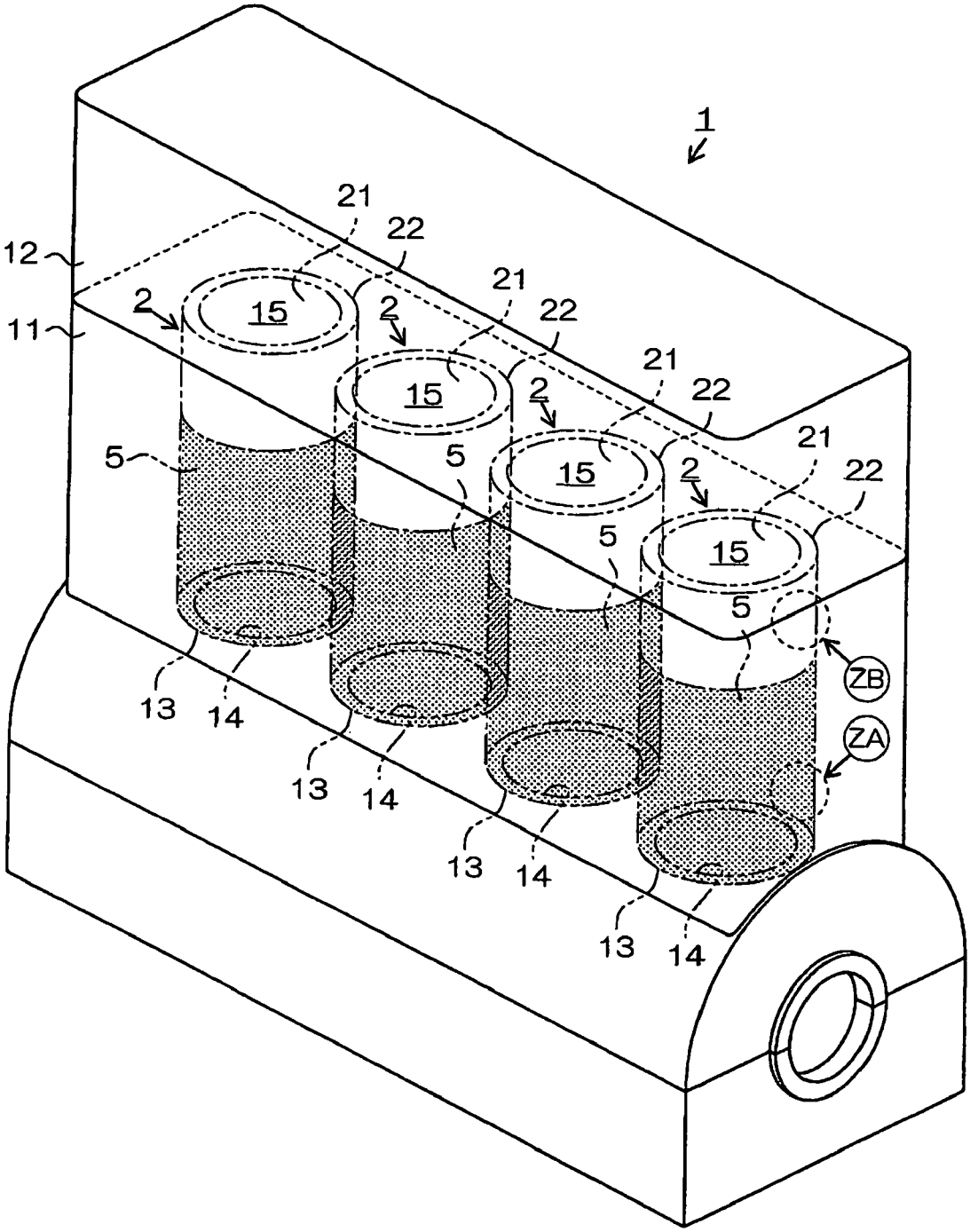
FIG. 1 is a schematic view illustrating an engine having cylinder liners according to a first embodiment of the present invention.

FIG. 1 shows the structure of an entire engine 1 made of an aluminum alloy having cylinder liners 2 according to the present embodiment.

The engine 1 includes a cylinder block 11 and a cylinder head 12. The cylinder block 11 includes a plurality of cylinders 13. Each cylinder 13 includes one cylinder liner 2.

A liner inner circumferential surface 21, which is an inner circumferential surface of each cylinder liner 2 forms the inner wall (cylinder inner wall 14) of the corresponding cylinder 13 in the cylinder block 11. Each liner inner circumferential surface 21 defines a cylinder bore 15.

Through the insert casting of a casting material, a liner outer circumferential surface 22, which is an outer circumferential surface of each cylinder liner 2, is brought into contact with the cylinder block 11.

As the aluminum alloy as the material of the cylinder block 11, for example, an alloy specified in Japanese Industrial Standard (JIS) ADC10 (related United States standard, ASTM A380.0) or an alloy specified in JIS ADC12 (related United States standard, ASTM A383.0) may be used. In the present embodiment, an aluminum alloy of ADC 12 is used as the material for the cylinder block 11.

Structure of Cylinder Liner

Figures 2, 3:
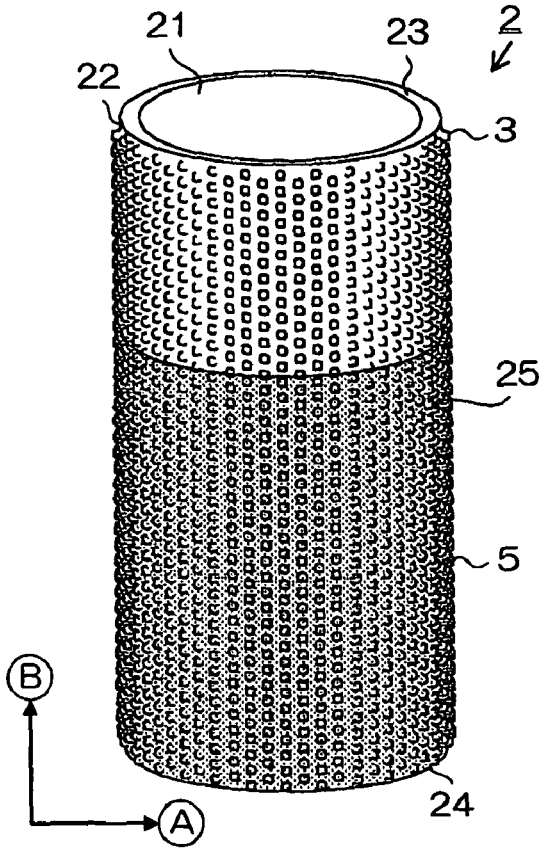
FIG. 2 is a perspective view illustrating the cylinder liner of the first embodiment.
FIG. 3 is a table showing one example of composition ratio of a cast iron, which is a material of the cylinder liner of the first embodiment.

FIG. 2 is a perspective view illustrating the cylinder liner 2 according to the present invention.

The cylinder liner 2 is made of cast iron. The composition of the cast iron is set, for example, as shown in FIG. 3. Basically, the components listed in table "Basic Component" may be selected as the composition of the cast iron. As necessary, components listed in table "Auxiliary Component" may be added.

The liner outer circumferential surface 22 of the cylinder liner 2 has projections 3, each having a constricted shape.

The projections 3 are formed on the entire liner outer circumferential surface 22 from a liner upper end 23, which is an upper end of the cylinder liner 2, to a liner lower end 24, which is a lower end of the cylinder liner 2. The liner upper end 23 is an end of the cylinder liner 2 that is located at a combustion chamber in the engine 1. The liner lower end 24 is an end of the cylinder liner 2 that is located at a portion opposite to the combustion chamber in the engine 1.

In the cylinder liner 2, a film 5 is formed on the liner outer circumferential surface 22. More specifically, the film 5 is formed on the liner outer circumferential surface 22 in an area from the liner upper end 23 to a liner middle portion 25, which is a middle portion of the cylinder liner 2 in the axial direction of the cylinder 13. The film 5 is formed along the entire circumferential direction of the cylinder liner 2.

The film 5 is formed of a sprayed layer of a ceramic material (ceramic sprayed layer 51). In the present embodiment, alumina is used as the ceramic material forming the ceramic sprayed layer 51. The sprayed layer 51 is formed by spraying (plasma spraying or HVOF spraying).

Structure of Projections

Figure 4:
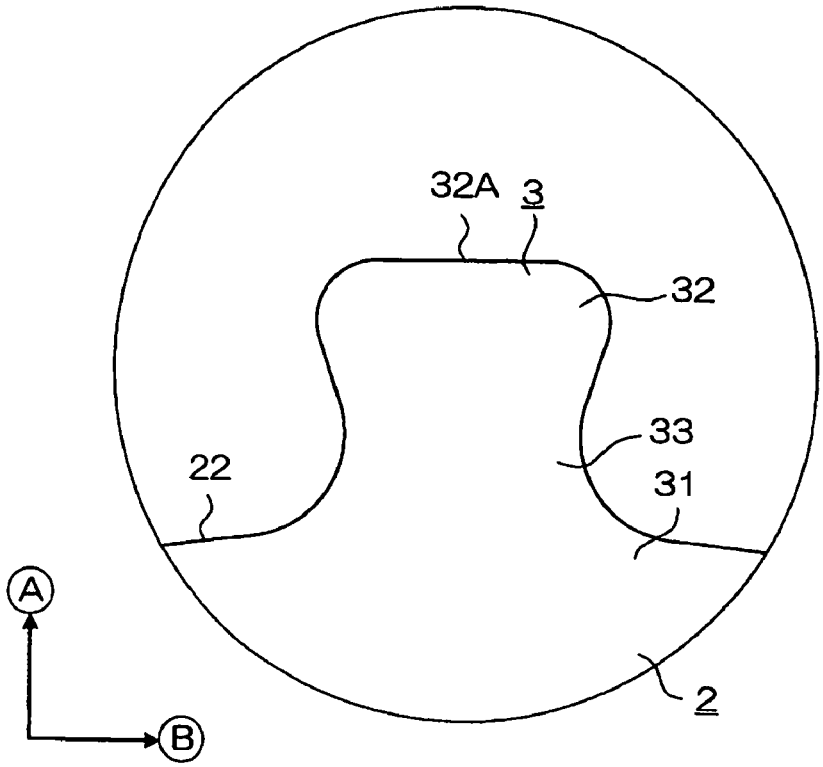
FIGS. 4 and 5 are model diagrams showing a projection having a constricted shape formed on the cylinder liner of the first embodiment.

FIG. 4 is a model diagram showing a projection 3. Hereafter, a direction of arrow A, which is a radial direction of the cylinder liner 2, is referred to as an axial direction of the projection 3. Also, a direction of arrow B, which is the axial direction of the cylinder liner 2, is referred to as a radial direction of the projection 3. FIG. 4 shows the shape of the projection 3 as viewed in the radial direction of the projection 3.

The projection 3 is integrally formed with the cylinder liner 2. The projection 3 is coupled to the liner outer circumferential surface 22 at a proximal end 31. At a distal end 32 of the projection 3, a smooth and flat top surface 32A that corresponds to a distal end surface of the projection 3 is formed.

In the axial direction of the projection 3, a constriction 33 is formed between the proximal end 31 and the distal end 32.

The constriction 33 is formed such that its cross-sectional area along the axial direction of the projection 3 (axial direction cross-sectional area SR) is less than an axial direction cross-sectional area SR at the proximal end 31 and at the distal end 32.

The projection 3 is formed such that the axial direction cross-sectional area SR gradually increases from the constriction 33 to the proximal end 31 and to the distal end 32.

Figure 5:
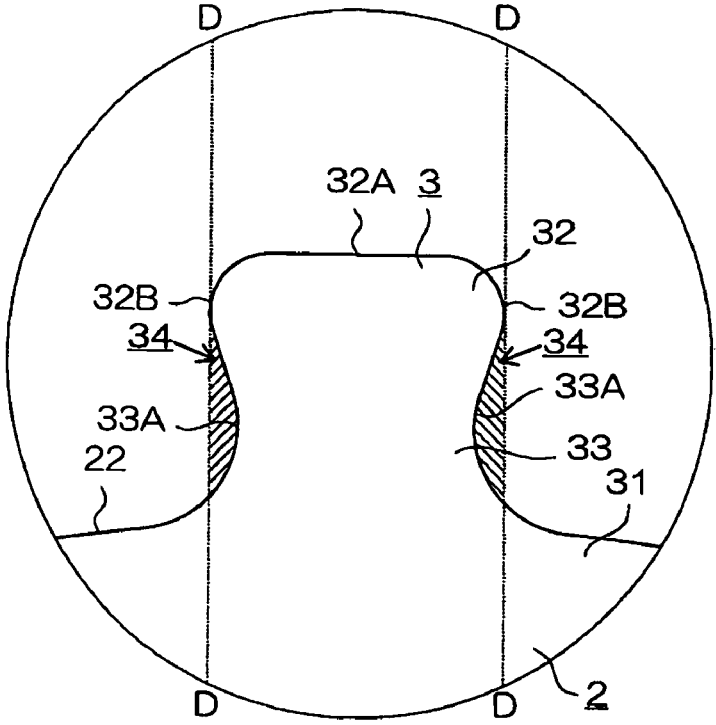

FIG. 5 is a model diagram showing the projection 3, in which a constriction space 34 of the cylinder liner 2 is marked. In each cylinder liner 2, the constriction 33 of each projection 3 creates the constriction space 34 (shaded areas in FIG. 5)

The constriction space 34 is a space surrounded by an imaginary cylindrical surface circumscribing a largest distal portion 32B (in FIG. 5, lines D-D corresponds to the cylindrical surface) and a constriction surface 33A, which is the surface of the constriction 33. The largest distal portion 32B represents a portion at which the diameter of the projection 3 is the longest in the distal end 32.

In the engine 1 having the cylinder liners 2, the cylinder block 11 and the cylinder liners 2 are bonded to each other with part of the cylinder block 11 located in the constriction spaces 34, in other words, with the cylinder block 11 engaged with the projections 3. Therefore, sufficient liner bond strength, which is the bond strength of the cylinder block 11 and the cylinder liners 2, is ensured. Also, since the increased liner bond strength suppresses deformation of the cylinder bores 15, the friction is reduced. Accordingly, the fuel consumption rate is improved.

Formation of Film

Referring to FIGS. 6A, 6B, 7A, 7B and 8, the formation of the film 5 on the cylinder liner 2 will be described. Hereafter, the thickness of the film 5 is referred to as a film thickness TP.

[1] Position of Film

Figures 6A, 6B:
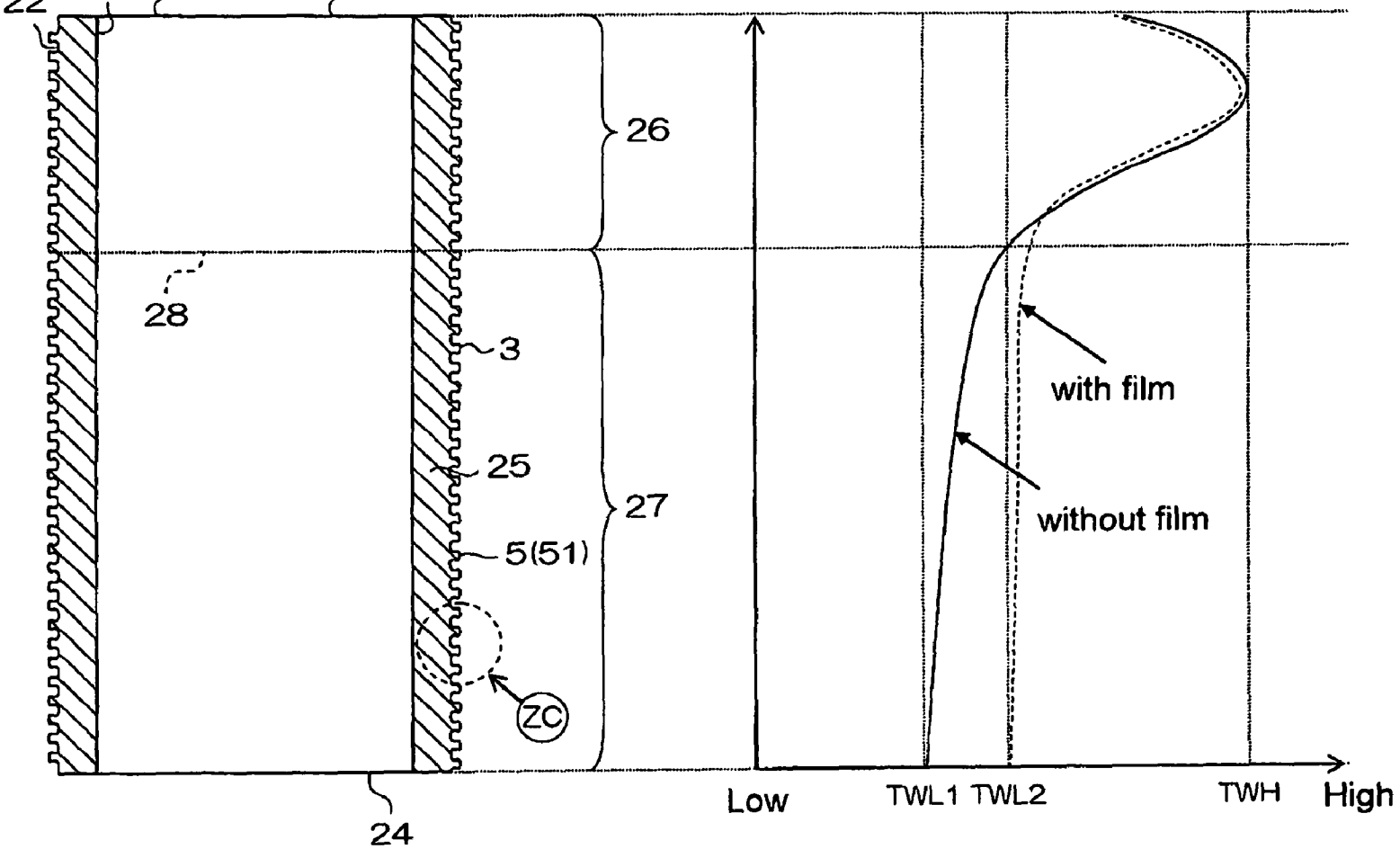
FIG. 6A is a cross-sectional view of the cylinder liner according to the first embodiment taken along the axial direction.
FIG. 6B is a graph showing one example of the relationship between axial positions and the temperature of the cylinder wall in the cylinder liner according to the first embodiment.

Referring to FIGS. 6A and 6B, the position of the film 5 will be described. FIG. 6A is a cross-sectional view of the cylinder liner 2 along the axial direction. FIG. 6B shows one example of variation in the temperature of the cylinder 13, specifically, in the cylinder wall temperature TW along the axial direction of the cylinder 13 in a normal operating state of the engine 1. Hereafter, the cylinder liner 2 from which the film 5 is removed will be referred to as a reference cylinder liner. An engine having the reference cylinder liners will be referred to as a reference engine.

In this embodiment, the position of the film 5 is determined based on the cylinder wall temperature TW in the reference engine.

The variation of the cylinder wall temperature TW will be described. In FIG. 6B, the solid line represents the cylinder wall temperature TW of the reference engine, and the broken line represents the cylinder wall temperature TW of the engine 1 of the present embodiment. Hereafter, the highest temperature of the cylinder wall temperature TW is referred to as a maximum cylinder wall temperature TWH, and the lowest temperature of the cylinder wall temperature TW will be referred to as a minimum cylinder wall temperature TWL.

In the reference engine, the cylinder wall temperature TW varies in the following manner.

(a) In an area from the liner lower end 24 to the liner middle portion 25, the cylinder wall temperature TW gradually increases from the liner lower end 24 to the liner middle portion 25 due to a small influence of combustion gas. In the vicinity of the liner lower end 24, the cylinder wall temperature TW is a minimum cylinder wall temperature TWL1. In the present embodiment, a portion of the cylinder liner 2 in which the cylinder wall temperature TW varies in such a manner is referred to as a low temperature liner portion 27.

(b) In an area from the liner middle portion 25 to the liner upper end 23, the cylinder wall temperature TW sharply increases due to a large influence of combustion gas. In the vicinity of the liner upper end 23, the cylinder wall temperature TW is a maximum cylinder wall temperature TWH. In the present embodiment, a portion of the cylinder liner 2 in which the cylinder wall temperature TW varies in such a manner is referred to as a high temperature liner portion 26.

In combustion engines including the above described reference engine, the cylinder wall temperature TW at a position corresponding to the low temperature liner portion 27 significantly falls below an appropriate temperature. This significantly increases the viscosity of the engine oil in the vicinity of the position. That is, the fuel consumption rate is inevitably degraded by the increase in the friction of the piston. Such deterioration of the fuel consumption rate due to the lowered cylinder wall temperature TW is particularly noticeable in engines in which the thermal conductivity of the cylinder block is relatively great (for example, an engine made of an aluminum alloy).

Accordingly, in the cylinder liner 2 according to the present embodiment, the film 5 is formed on the low temperature liner portion 27, so that the thermal conductivity between the cylinder block 11 and the low temperature liner portion 27 is reduced. This increases the cylinder wall temperature TW at the low temperature liner portion 27.

In the engine 1 of the present embodiment, since the cylinder block 11 and the low temperature liner portion 27 are bonded to each other with the film 5 having a heat insulation property in between. This reduces the thermal conductivity between the cylinder block 11 and the low temperature liner portion 27. Accordingly, the cylinder wall temperature TW in the low temperature liner portion 27 is increased. This causes the minimum cylinder wall temperature TWL to be a minimum cylinder wall temperature TWL2, which is higher than the minimum cylinder wall temperature TWL1. As the cylinder wall temperature TW increases, the viscosity of the engine oil is lowered, which reduces the friction of the piston. Accordingly, the fuel consumption rate is improved.

A wall temperature boundary 28, which is the boundary between the high temperature liner portion 26 and the low temperature liner portion 27, can be obtained based on the cylinder wall temperature TW of the reference engine. On the other hand, it has been found out that in many cases the length of the low temperature liner portion 27 (the length from the liner lower end 24 to the wall temperature boundary 28) is two thirds to three quarter of the entire length of the cylinder liner 2 (the length from the liner upper end 23 to the liner lower end 24). Therefore, when determining the position of the film 5, two-thirds to three-quarters range from the liner lower end 24 in the entire liner length may be treated as the low temperature liner portion 27 without precisely determining the wall temperature boundary 28.

[2] Thickness of Film

Figures 7A, 7B:
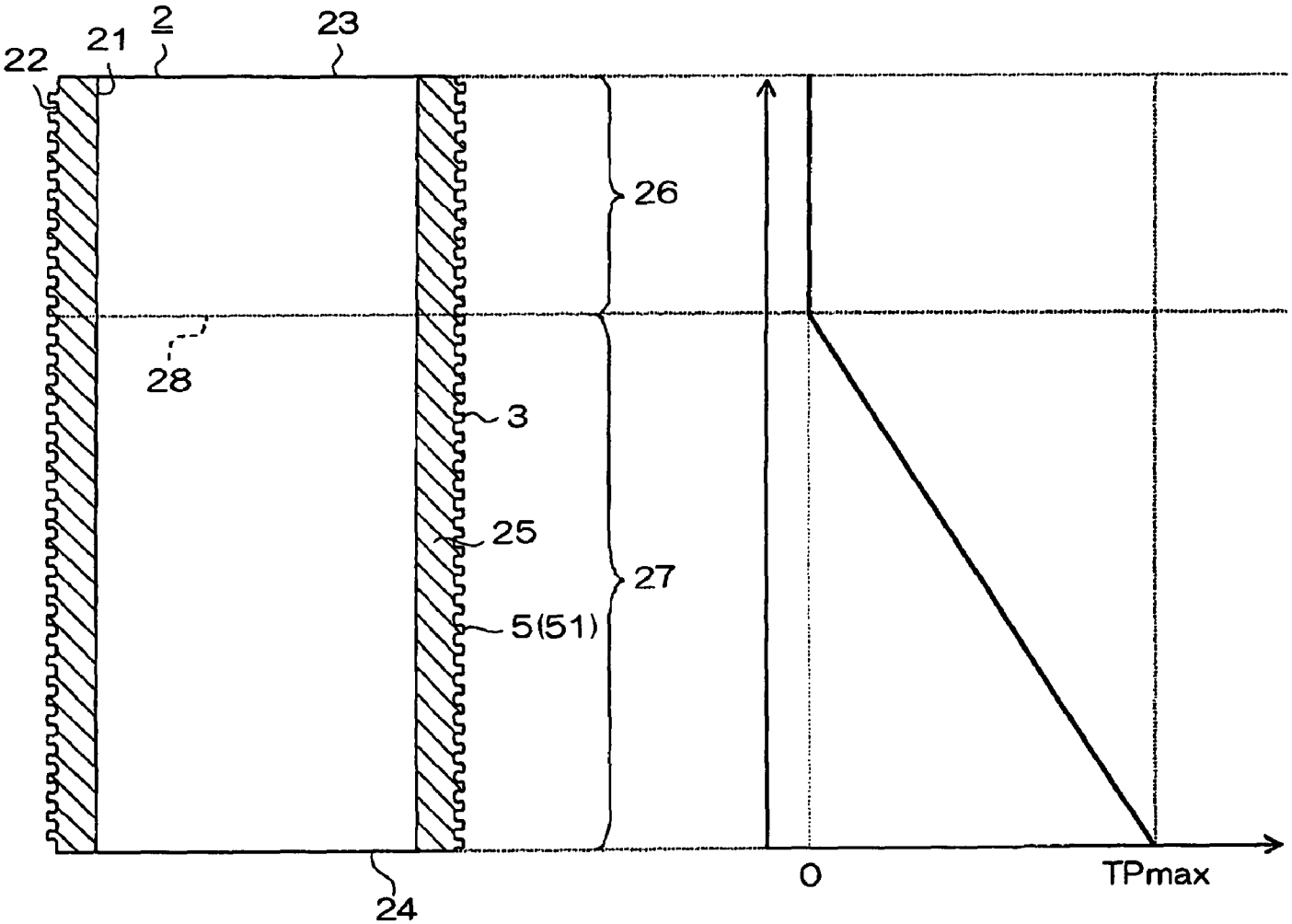
FIG. 7A is a cross-sectional view of the cylinder liner according to the first embodiment taken along the axial direction.
FIG. 7B is a graph showing one example of the relationship between axial positions and the thickness of a film in the cylinder liner according to the first embodiment.

Referring to FIGS. 7A and 7B, the setting of the film thickness TP will be described. FIG. 7A is a cross-sectional view of the cylinder liner 2 taken along the axial direction. FIG. 7B shows the relationship between the axial position and the film thickness TP in the cylinder liner 2.

In the cylinder liner 2, the film thickness TP is determined in the following manner.

(A) The film thickness TP is set to gradually increase from the wall temperature boundary 28 to the liner lower end 24. That is, the film thickness TP is set to zero at the wall temperature boundary 28, while being set to the maximum value at the liner lower end 24 (maximum thickness TPmax).

(B) The film thickness TP is set equal to or less than 0.5 mm. In the present embodiment, the film 5 is formed such that a mean value of the film thickness TP in a plurality of positions of the low temperature liner portion 27 is less than or equal to 0.5 mm. However, the film 5 can be formed such that the film thickness TP is less than or equal to 0.5 mm in the entire low temperature liner portion 27.

[3] Formation of Film about Projections

Figure 8:
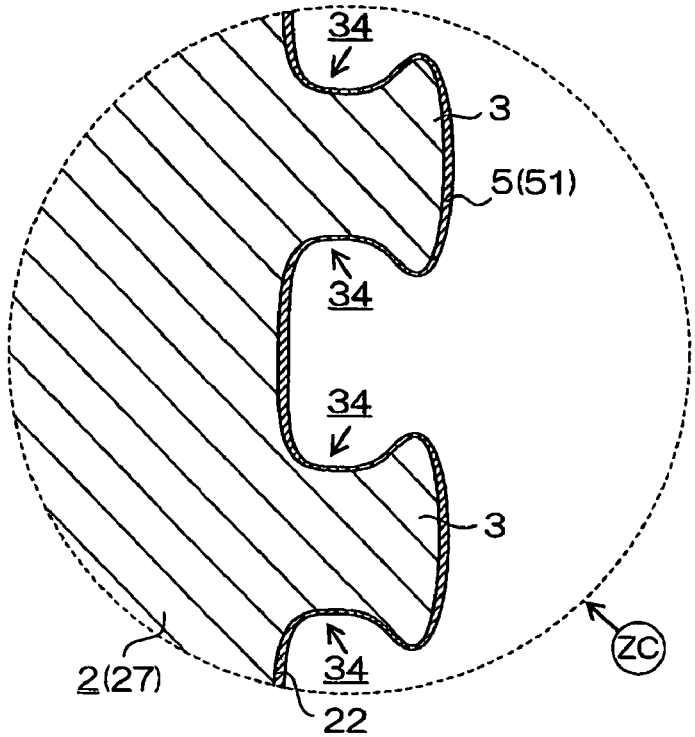
FIG. 8 is an enlarged cross-sectional view of the cylinder liner according to the first embodiment, showing encircled part ZC of FIG. 6A.

FIG. 8 is an enlarged view showing encircled part ZC of FIG. 6A. In the cylinder liner 2, the film 5 is formed on the liner outer circumferential surface 22 such that the constriction spaces 34 are not filled. That is, the film 5 is formed such that, when performing the insert casting of the cylinder liners 2, the casting material fills the constriction spaces 34. If the constriction spaces 34 are filled by the film 5, the casting material will not fill the constriction spaces 34. Thus, no anchor effect of the projections 3 will be obtained in the low temperature liner portion 27.

Bonding State of Cylinder Block and Cylinder Liner

Figure 9:
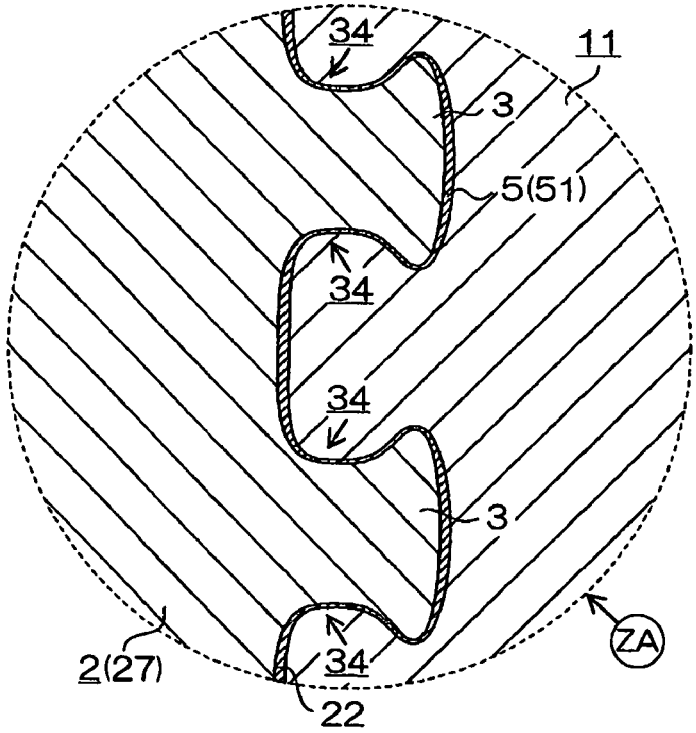
FIG. 9 is an enlarged cross-sectional view of the cylinder liner according to the first embodiment, showing encircled part ZA of FIG. 1.
Figure 10:
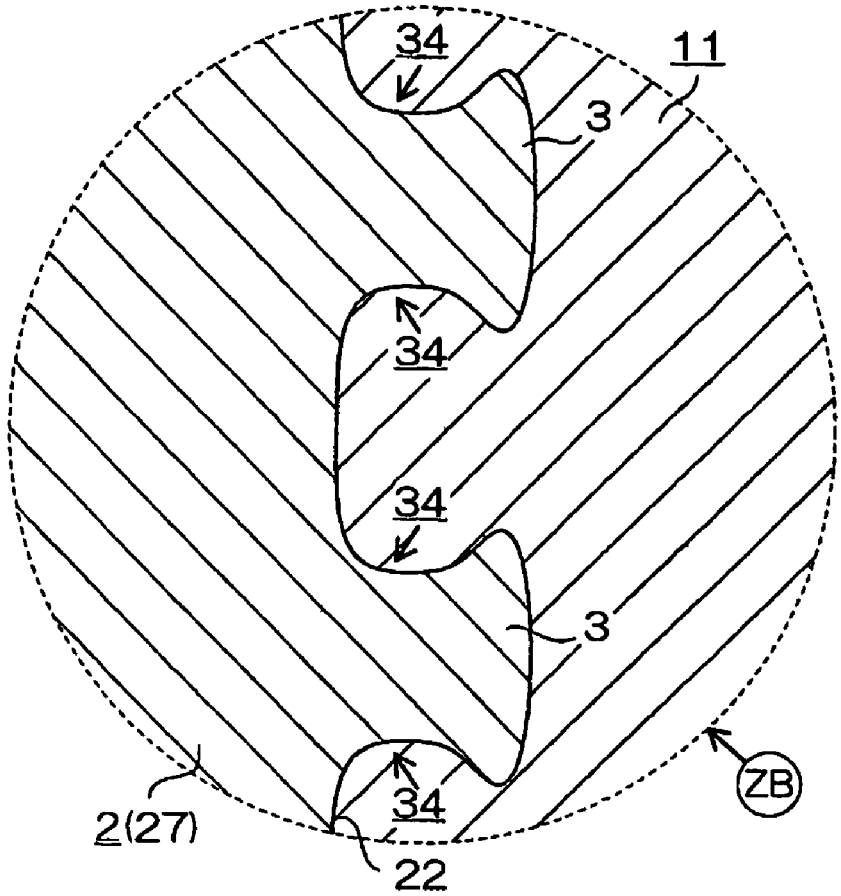
FIG. 10 is an enlarged cross-sectional view of the cylinder liner according to the first embodiment, showing encircled part ZB of FIG. 1.

Referring to FIGS. 9 and 10, the bonding state of the cylinder block 11 and the cylinder liner 2 will be described. FIGS. 9 and 10 are cross-sectional views showing the cylinder block 11 taken along the axis of the cylinder 13.

[1] Bonding State of Low Temperature Liner Portion

FIG. 9 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of alumina, which has a lower thermal conductivity than that of the cylinder block 11, the cylinder block 11 and the film 5 are mechanically bonded to each other in a state of a low thermal conductivity.

In the engine 1, since the cylinder block 11 and the low temperature liner portion 27 are bonded to each other in this state, the following advantages are obtained.

(A) Since the film 5 reduces the thermal conductivity between the cylinder block 11 and the low temperature liner portion 27, the cylinder wall temperature TW in the low temperature liner portion 27 is increased.

(B) Since the projections 3 ensures the bond strength between the cylinder block 11 and the low temperature liner portion 27, exfoliation of the cylinder block 11 and the low temperature liner portion 27 is suppressed.

[2] Bonding State of High Temperature Liner Portion

FIG. 10 is a cross-sectional view of encircled part ZB of FIG. 1 and shows the bonding state between the cylinder block 11 and the high temperature liner portion 26.

In the engine 1, the cylinder block 11 is bonded to the high temperature liner portion 26 in a state where the cylinder block 11 is engaged with the projections 3. Therefore, sufficient bond strength between the cylinder block 11 and the high temperature liner portion 26 is ensured by the anchor effect of the projections 3. Also, sufficient thermal conductivity between the cylinder block 11 and the high temperature liner portion 26 is ensured.

Formation of Projections

Referring to Table 1, the formation of the projections 3 on the cylinder liner 2 will be described.

As parameters related to the projection 3, a first area ratio SA, a second area ratio. SB, a standard cross-sectional area SD, a standard projection density NP, and a standard projection height HP are defined.

A measurement height H, a first reference plane PA, and a second reference plane PB, which are basic values for the above parameters related to the projection 3, will now be described.

(a) The measurement height H represents the distance from proximal end of the projection 3 along the axial direction of the projection 3. At the proximal end of the projection 3, the measurement height H is zero. At the top surface 32A of the projection 3, the measurement height H has the maximum value.

(b) The first reference plane PA represents a plane that lies along the radial direction of the projection 3 at the position of the measurement height of 0.4 mm.

(c) The second reference plane PB represents a plane that lies along the radial direction of the projection 3 at the position of the measurement height of 0.2 mm.

The parameters related to the projection 3 will now be described.

[A] The first area ratio SA represents the ratio of a radial direction cross-sectional area SR of the projections 3 in a unit area of the first reference plane PA. More specifically, the first area ratio SA represents the ratio of the area obtained by adding up the area of regions each surrounded by a contour line of a height of 0.4 mm to the area of the entire contour diagram of the liner outer circumferential surface 22.

[B] The second area ratio SB represents the ratio of a radial direction cross-sectional area SR of the projections 3 in a unit area of the second reference plane PB. More specifically, the second area ratio SB represents the ratio of the area obtained by adding up the area of regions each surrounded by a contour line of a height of 0.2 mm to the area of the entire contour diagram of the liner outer circumferential surface 22.

[C] The standard cross-sectional area SD represents a radial direction cross-sectional area SR, which is the area of one projection 3 in the first reference plane PA. That is, the standard cross-sectional area SD represents the area of each region surrounded by a contour line of a height of 0.4 mm in the contour diagram of the liner outer circumferential surface 22.

[D] The standard projection density NP represents the number of the projections 3 per unit area in the liner outer circumferential surface 22.

[E] The standard projection height HP represents the height H of each projection 3.

TABLE 1

| | Type of Parameter | Selected Range |
|---|---|---|
| [A] | First area ratio SA | 10 to 50% |
| [B] | Second Area Ratio SB | 20 to 55% |
| [C] | Standard Cross-Sectional Area SD | 0.2 to 3.0 $mm^2$ |
| [D] | Standard Projection Density NP | 5 to 60 number/$cm^2$ |
| [E] | Standard Projection Height HP | 0.5 to 1.0 mm |

In the present embodiment, the parameters [A] to [E] are set to be within the selected ranges in Table 1, so that the effect of increase of the liner bond strength by the projections 3 and the filling factor of the casting material between the projections 3 are increased. In addition, the projections 3 are formed on the cylinder liner 2 to be independent from one another on the first reference plane PA in the present embodiment. In other words, a cross-section of each projection 3 by a plane containing the contour line representing a height of 0.4 mm from its proximal end is independent from cross-sections of the other projections 3 by the same plane. This further increases the filling factor.

Method for Producing Cylinder Liner

Referring to FIGS. 11 and 12 and Table 2, a method for producing the cylinder liner 2 will be described.

In the present embodiment, the cylinder liner 2 is produced by centrifugal casting. To make the above listed parameters related to the projections 3 fall in the selected ranges of Table 1, the following parameters [A] to [F] related to the centrifugal casting are set be within selected range of Table 2.

[A] The composition ratio of a refractory material 61A in a suspension 61.

[B] The composition ratio of a binder 61B in the suspension 61.

[C] The composition ratio of water 61C in the suspension 61.

[D] The average particle size of the refractory material 61A.

[E] The composition ratio of added surfactant 62 to the suspension 61.

[F] The thickness of a layer of a mold wash 63 (mold wash layer 64).

TABLE 2

| | Type of parameter | Selected range |
|---|---|---|
| [A] | Composition ratio of refractory material | 8 to 30% by mass |
| [B] | Composition ratio of binder | 2 to 10% by mass |
| [C] | Composition ratio of water | 60 to 90% by mass |
| [D] | Average particle size of refractory material | 0.02 to 0.1 mm |
| [E] | Composition ratio of surfactant | more than 0.005% by mass and 0.1% by mass or less |
| [F] | Thickness of mold wash layer | 0.5 to 1.0 mm |

The production of the cylinder liner 2 is executed according to the procedure shown in FIGS. 11A to 11F.

Figure 11A:
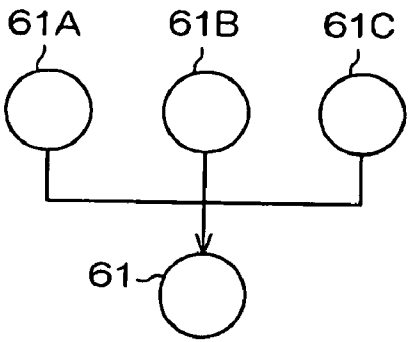
FIGS. 11A, 11B, 11C, 11D, 11E and 11F are process diagrams showing steps for producing a cylinder liner through the centrifugal casting.

[Step A] The refractory material 61A, the binder 61B, and the water 61C are compounded to prepare the suspension 61 as shown in FIG. 11A. In this step, the composition ratios of the refractory material 61A, the binder 61B, and the water 61C, and the average particle size of the refractory material 61A are set to fall within the selected ranges in Table 2.

Figure 11B:
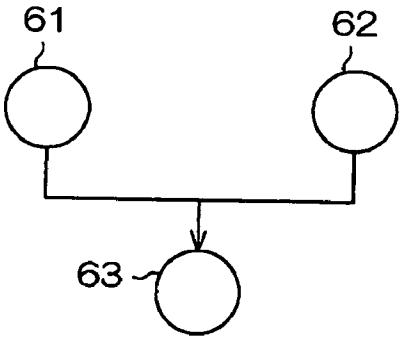

[Step B] A predetermined amount of the surfactant 62 is added to the suspension 61 to obtain the mold wash 63 as shown in FIG. 11B. In this step, the ratio of the added surfactant 62 to the suspension 61 is set to fall within the selected range shown in Table 2.

Figure 11C:
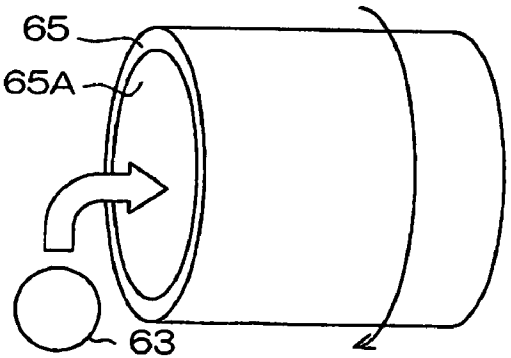

[Step C] After heating the inner circumferential surface of a rotating mold 65 to a predetermined temperature, the mold wash 63 is applied through spraying on an inner circumferential surface of the mold 65 (mold inner circumferential surface 65A), as shown in FIG. 11C. At this time, the mold wash 63 is applied such that a layer of the mold wash 63 (mold wash layer 64) of a substantially uniform thickness is formed on the entire mold inner circumferential surface 65A. In this step, the thickness of the mold wash layer 64 is set to fall within the selected range shown in Table 2.

Figures 12A, 12B, 12C:
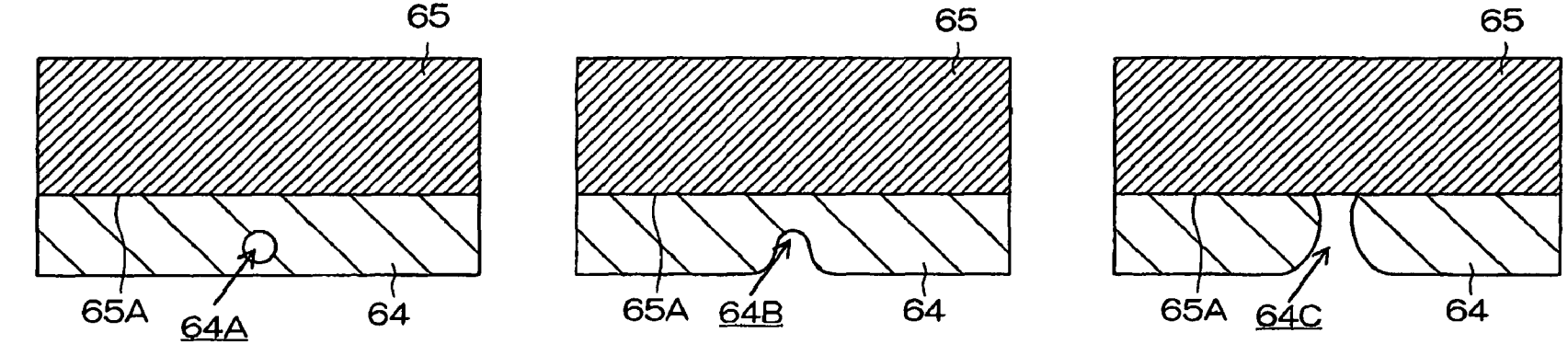
FIGS. 12A, 12B and 12C are process diagrams showing steps for forming a recess having a constricted shape in a mold wash layer in the production of the cylinder liner through the centrifugal casting.

In the mold wash layer 64 of the mold 65, holes having a constricted shape are formed after [Step C]. Referring to FIGS. 12A to 12*c*, the formation of the holes having a constricted shape will be described.

[1] The mold wash layer 64 with a plurality of bubbles 64A is formed on the mold inner circumferential surface 65A of the mold 65, as shown in FIG. 12A.

[2] The surfactant 62 acts on the bubbles 64A to form recesses 64B in the inner circumferential surface of the mold wash layer 64, as shown in FIG. 12B.

[3] The bottom of the recess 64B reaches the mold inner circumferential surface 65A, so that a hole 64C having a constricted shape is formed in the mold wash layer 64, as shown in FIG. 12C.

Figure 11D:
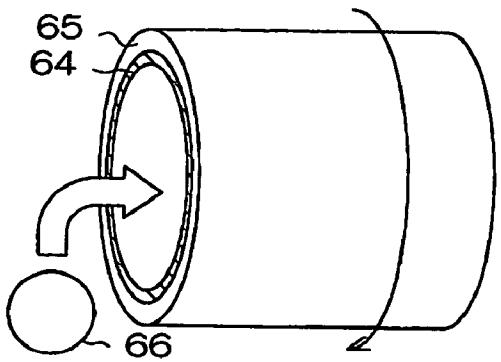

[Step D] After the mold wash layer 64 is dried, molten cast iron 66 is poured into the mold 65, which is being rotated, as shown in FIG. 11D. The molten cast iron 66 flows into the hole 64C having a constricted shape in the mold wash layer 64. Thus, the projections 3 having a constricted shape are formed on the cast cylinder liner 2.

Figure 11E:
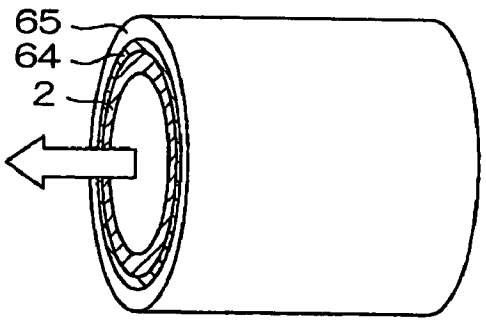

[Step E] After the molten cast iron 66 is hardened and the cylinder liner 2 is formed, the cylinder liner 2 is taken out of the mold 65 with the mold wash layer 64, as shown in FIG. 11E.

Figure 11F:
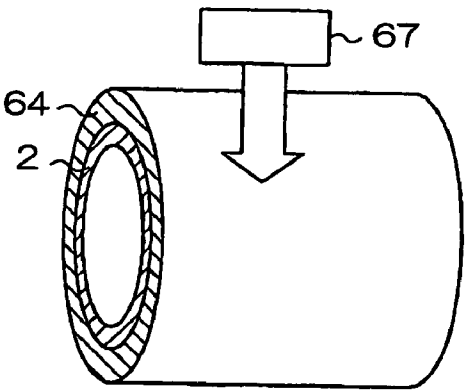

[Step F] Using a blasting device 67, the mold wash layer 64 (mold wash 63) is removed from the outer circumferential surface of the cylinder liner 2, as shown in. FIG. 11F.

Method for Measuring Parameters related to Projections

Figure 13B:
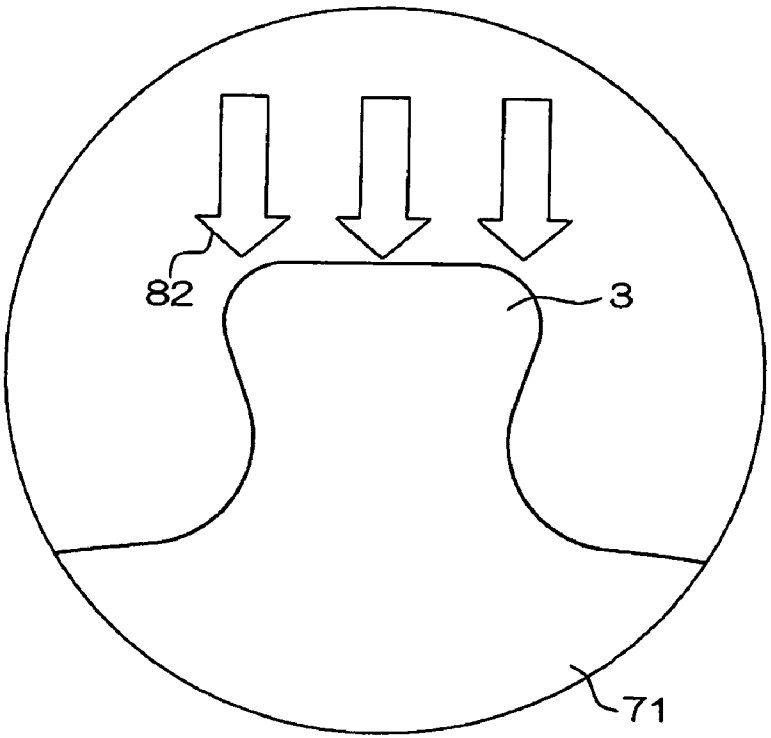
FIGS. 13A and 13B are diagrams showing one example of the procedure for measuring parameters of the cylinder liner according to the first embodiment, using a three-dimensional laser.
Figure 13A:
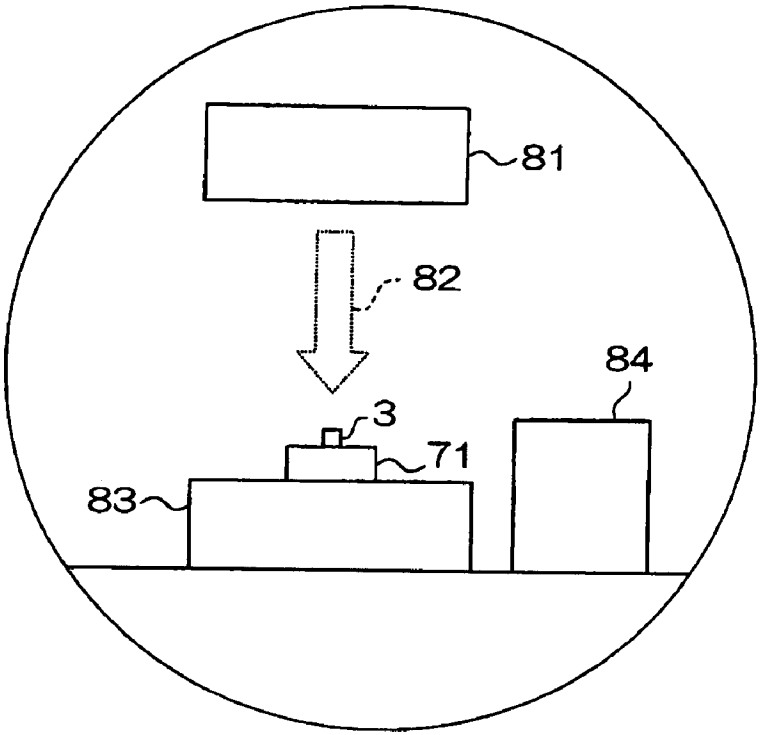

Referring to FIGS. 13A and 13B, a method for measuring the parameters related to projections 3 using a three-dimensional laser will be described. The standard projection height HP is measured by another method.

Each of the parameters related to the projections 3 can be measured in the following manner.

[1] A test piece 71 for measuring parameters of projections 3 is made from the cylinder liner 2.

[2] In a noncontact three-dimensional laser measuring device 81, the test piece 71 is set on a test bench 83 such that the axial direction of the projections 3 is substantially parallel to the irradiation direction of laser light 82 (FIG. 13A).

[3] The laser light 82 is irradiated from the three-dimensional laser measuring device 81 to the test piece 71 (FIG. 13B).

[4] The measurement results of the three-dimensional laser measuring device 81 are imported into an image processing device 84.

[5] Through the image processing performed by the image processing device 84, a contour diagram 85 (FIG. 14) of the liner outer circumferential surface 22 is displayed. The parameters related to the projections 3 are computed based on the contour diagram 85.

Contour Lines of Liner Outer Circumferential Surface

Figure 14:
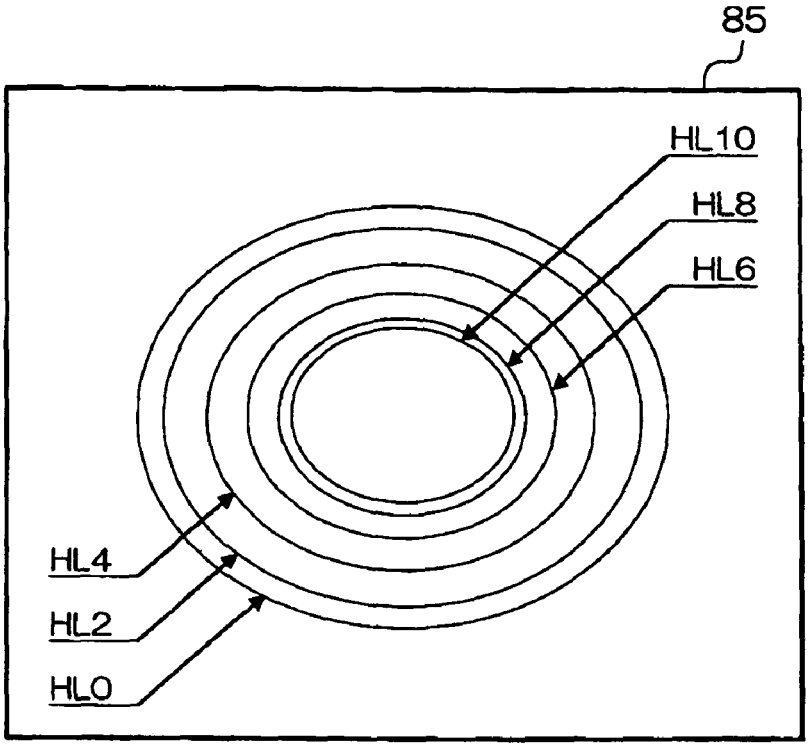
FIG. 14 is a diagram partly showing one example of contour lines of the cylinder liner according to the first embodiment, obtained through measurement using a three-dimensional laser.
Figure 15:
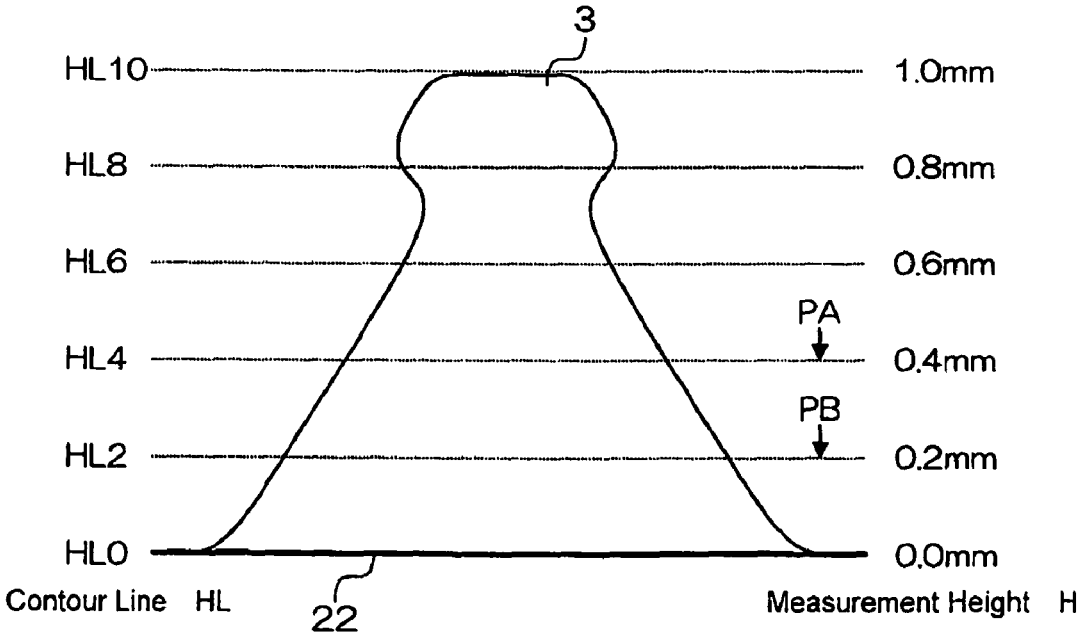
FIG. 15 is a diagram showing the relationship between the measured height and the contour lines of the cylinder liner of the first embodiment.

Referring to FIGS. 14 and 15, the contour diagram 85 will be explained. FIG. 14 is a part of one example of the contour diagram 85. FIG. 15 shows the relationship between the measurement height H and contour lines HL. The contour diagram 85 of FIG. 14 is drawn based in accordance with the liner outer circumferential surface 22 having a projection 3 that is different from the projection 3 of FIG. 15.

In the contour diagram 85, the contour lines HL are shown at every predetermined value of the measurement height H.

For example, in the case where the contour lines HL are shown at a 0.2 mm interval from the measurement height of 0 mm to the measurement height of 1.0 mm in the contour diagram 85, contour lines HL0 of the measurement height of 0 mm, contour lines HL2 of the measurement height of 0.2 mm, contour lines HL4 of the measurement height of 0.4 mm, contour lines HL6 of the measurement height of 0.6 mm, contour lines HL8 of the measurement height of 0.8 mm, and contour lines HL10 of the measurement height of 1.0 mm are shown.

The contour lines HL 4 are contained in first reference plane PA. The contour lines HL 2 are contained in the second reference plane PB. Although FIG. 14 shows a diagram in which the contour lines HL are shown at a 0.2 mm interval, the distance between the contour lines HL may be changed as necessary.

Figure 16:
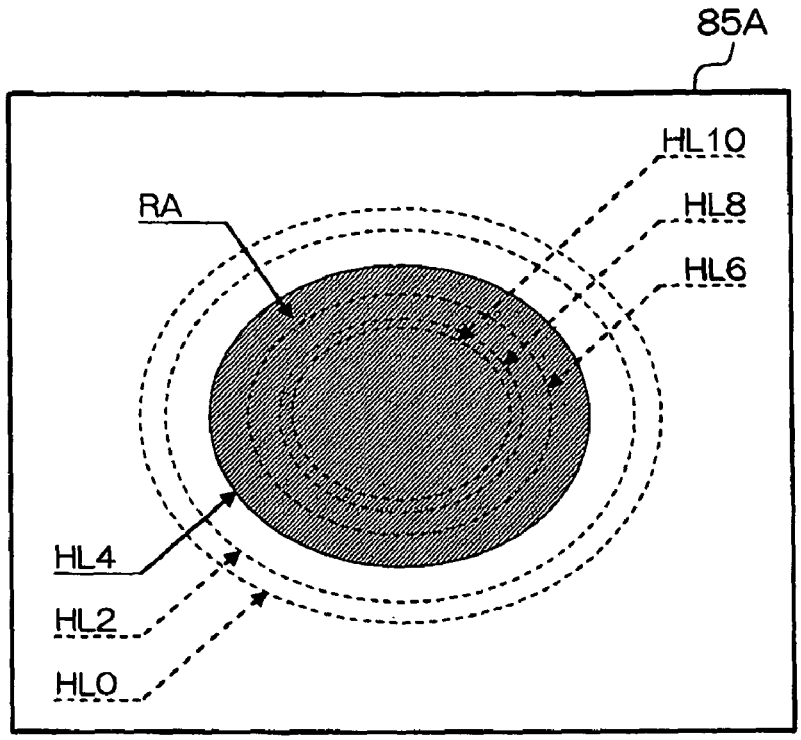
FIGS. 16 and 17 are diagrams each partly showing another example of contour lines of the cylinder liner according to the first embodiment, obtained through measurement using a three-dimensional laser.
Figure 17:
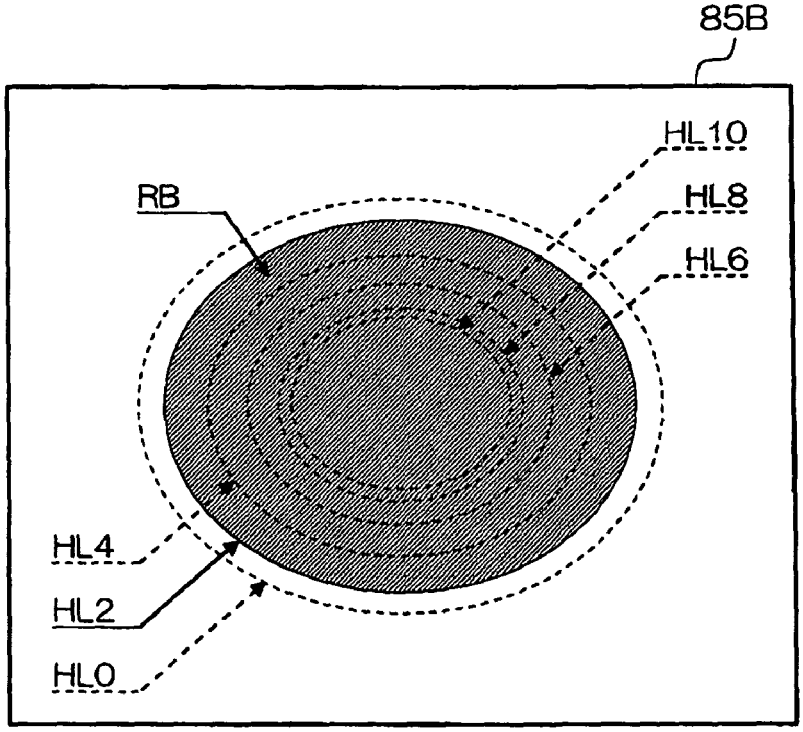

Referring to FIGS. 16 and 17, first regions RA and second regions RB in the contour diagram 85 will be described. FIG. 16 is a part of a first contour diagram 85A, in which the contour lines HL4 of the measurement height of 0.4 mm in the contour diagram 85 are shown in solid lines and the other contour lines HL in the contour diagram 85 are shown in dotted lines. FIG. 17 is a part of a second contour diagram 85B, in which the contour lines HL2 of the measurement height of 0.2 mm in the contour diagram 85 are shown in solid lines and the other contour lines HL in the contour diagram 85 are shown in dotted lines.

In the present embodiment, regions each surrounded by the contour line HL4 in the contour diagram 85 are defined as the first regions RA. That is, the shaded areas in the first contour diagram 85A correspond to the first regions RA. Regions each surrounded by the contour line HL2 in the contour diagram 85 are defined as the second regions RB. That is, the shaded areas in the second contour diagram 85B correspond to the second regions RB.

Method for Computing Parameters related to Projections

As for the cylinder liner 2 according to the present embodiment, the parameters related to the projections 3 are computed in the following manner based on the contour diagram 85.

[A] First Area Ratio SA

The first area ratio SA is computed as the ratio of the total area of the first regions RA to the area of the entire contour diagram 85. That is, the first area ratio SA is computed by using the following formula.

$$SA=SRA/ST\times 100[\%]$$

In the above formula, the symbol ST represents the area of the entire contour diagram 85. The symbol SRA represents the total area of the first regions RA in the contour diagram 85. For example, when FIG. 16, which shows a part of the first contour diagram 85A, is used as a model, the area of the rectangular zone surrounded by the frame corresponds to the area ST, and the area of the shaded zone corresponds to the area SRA. When computing the first area ratio SA, the contour diagram 85 is assumed to include only the liner outer circumferential surface 22.

[B] Second Area Ratio SB

The second area ratio SB is computed as the ratio of the total area of the second regions RB to the area of the entire contour diagram 85. That is, the second area ratio SB is computed by using the following formula.

$$SB=SRB/ST\times 100[\%]$$

In the above formula, the symbol ST represents the area of the entire contour diagram 85. The symbol SRB represents the total area of the second regions RB in the entire contour diagram 85. For example, when FIG. 17, which shows a part of the second contour diagram 85B, is used as a model, the area of the rectangular zone surrounded by the frame corresponds to the area ST, and the area of the shaded zone corresponds to the area SRB. When computing the second area ratio SB, the contour diagram 85 is assumed to include only the liner outer circumferential surface 22.

[C] Standard Cross-sectional Area SD

The standard cross-sectional area SD can be computed as the area of each first region RA in the contour diagram 85. For example, when FIG. 16, which shows a part of the first contour diagram 85A, is used as a model, the area of the shaded area corresponds to standard cross-sectional area SD.

[D] Standard Projection Density NP

The standard projection density NP can be computed as the number of projections 3 per unit area in the contour diagram 85 (in this embodiment, 1 $cm^2$).

[E] Standard Projection Height HP

The standard projection height HP represents the height of each projection 3. The height of each projection 3 may be a mean value of the heights of the projection 3 at several locations. The height of each projection 3 can be measured by a measuring device such as a dial depth gauge.

Whether the projections 3 are independently provided on the first reference plane PA can be checked based on the first regions RA in the contour diagram 85. That is, when each first region RA does not interfere with other first regions RA, it is confirmed that the projections 3 are independently provided on the first reference plane PA. In other words, it is confirmed that a cross-section of each projection 3 by a plane containing the contour line representing a height of 0.4 mm from its proximal end is independent from cross-sections of the other projections 3 by the same plane.

Method for Evaluating Bond Strength

Figure 18C:
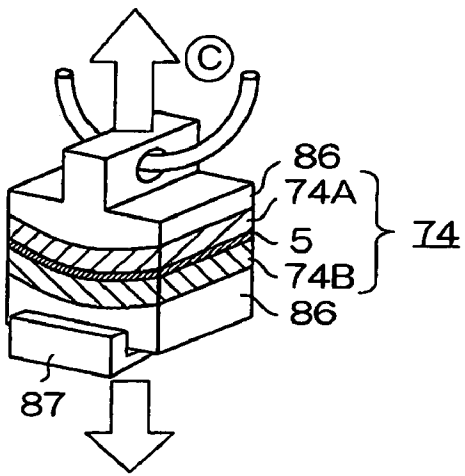
FIGS. 18A, 18B and 18C are diagrams showing one example of a procedure of a tensile test for evaluating the bond strength of the cylinder liner according to the first embodiment in a cylinder block.
Figure 18B:
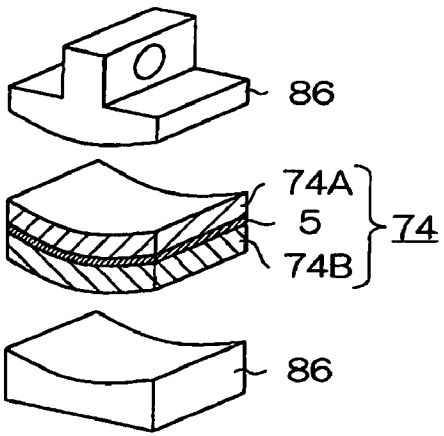
Figure 18A:
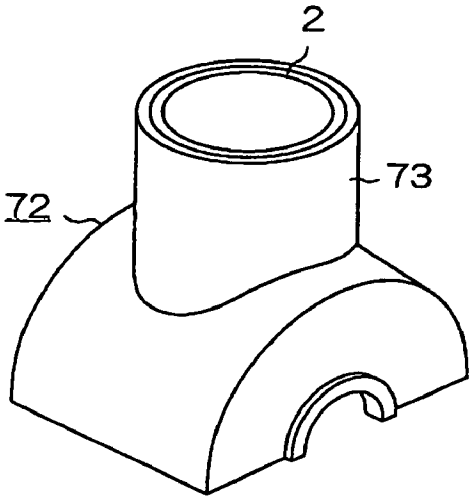

Referring to FIGS. 18A to 18C, one example of the evaluation of the bond strength between the cylinder block 11 and the cylinder liner 2 will be explained.

The evaluation of the bond strength of the low temperature liner portion 27 may be performed according to the procedure of the following steps [1] to [5].

[1] Single cylinder type cylinder blocks 72, each having a cylinder liner 2, were produced through die casting (FIG. 18A).

[2] Test pieces 74 for strength evaluation were made from the single cylinder type cylinder blocks 72. The strength evaluation test pieces 74 were each formed of a part of the low temperature liner portion 27 of the cylinder liner 2 (the liner piece 74A and the film 5) and an aluminum part of the cylinder 73 (aluminum piece 74B).

[3] Arms 86 of a tensile test device were bonded to the strength evaluation test piece 74, which includes the liner piece 74A and the aluminum piece 74B (FIG. 18B)

[4] After one of the arms 86 was held by a clamp 87, a tensile load was applied to the strength evaluation test piece 74 by the other arm 86 such that liner piece 74A and the aluminum piece 74B were exfoliated in a direction of arrow C, which is a radial direction of the cylinder (FIG. 18C).

[5] Through the tensile test, the magnitude of the load per unit area at which the liner piece 74A and the aluminum piece 74B were exfoliated was obtained as the liner bond strength. The evaluation of the bond strength of the high temperature liner portion 26 of the cylinder liner 2 may also be performed according to the procedure of the above steps [1] to [5].

The bond strength between the cylinder block 11 and the cylinder liner 2 of the engine 1 according to the present embodiment was measured according to the above evaluation method. It was confirmed that the bond strength of the engine 1 was sufficiently higher than that of the reference engine.

Advantages of First Embodiment

The cylinder liner 2 according to the present embodiment provides the following advantages.

(1) In the cylinder liner 2 of the present embodiment, the film 5 is formed on the liner outer circumferential surface 22 of the low temperature liner portion 27. This increases the cylinder wall temperature TW at the low temperature liner portion 27 of the engine 1, and thus lowers the viscosity of the engine oil. Accordingly, the fuel consumption rate is improved.

(2) In the cylinder liner 2 of the present embodiment, the projections 3 are formed on the liner outer circumferential surface 22. This permits the cylinder block 11 and cylinder liner 2 to be bonded to each other with the cylinder block 11 and the projections 3 engaged with each other. Sufficient bond strength between the cylinder block 11 and the cylinder liner 2 is ensured. The increase in the bond strength prevents the cylinder bore 15 from being deformed.

(3) In the cylinder liner 2 of the present embodiment, the film 5 is formed such that its thickness TP is less than or equal to 0.5 mm. This prevents the bond strength between the cylinder block 11 and the low temperature liner portion 27 from being lowered. If the film thickness TP is greater than 0.5 mm, the anchor effect of the projections 3 will be reduced, resulting in a significant reduction in the bond strength between the cylinder block 11 and the low temperature liner portion 27.

(4) In the cylinder liner 2 of the present embodiment, the projections 3 are formed such that the standard projection density NP is in the range from $5/cm^2$ to $60/cm^2$. This further increases the liner bond strength. Also, the filling factor of the casting material to spaces between the projections 3 is increased.

If the standard projection density NP is out of the selected range, the following problems will be caused. If the standard projection density NP is less than $5/cm^2$, the number of the projections 3 will be insufficient. This will reduce the liner bond strength. If the standard projection density NP is more than $60/cm^2$, narrow spaces between the projections 3 will reduce the filing factor of the casting material to spaces between the projections 3.

(5) In the cylinder liner 2 of the present embodiment, the projections 3 are formed such that the standard projection height HP is in the range from 0.5 mm to 1.0 mm. This increases the liner bond strength and the accuracy of the outer diameter of the cylinder liner 2.

If the standard projection height HP is out of the selected range, the following problems will be caused. If the standard projection height HP is less 0.5 mm, the height of the projections 3 will be insufficient. This will reduce the liner bond strength. If the standard projection height HP is more 1.0 mm, the projections 3 will be easily broken. This will also reduce the liner bond strength. Also, since the heights of the projection 3 are uneven, the accuracy of the outer diameter is reduced.

(6) In the cylinder liner 2 of the present embodiment, the projections 3 are formed such that the first area ratio SA is in the range from 10% to 50%. This ensures sufficient liner bond strength. Also, the filling factor of the casting material to spaces between the projections 3 is increased.

If the first area ratio SA is out of the selected range, the following problems will be caused. If the first area ratio SA is less than 10%, the liner bond strength will be significantly reduced compared to the case where the first area ratio SA is more than or equal to 10%. If the first area ratio SA is more than 50%, the second area ratio SB will surpass the upper limit value (55%). Thus, the filling factor of the casting material in the spaces between the projections 3 will be significantly reduced.

(7) In the cylinder liner 2 of the present embodiment, the projections 3 are formed such that the second area ratio SB is in the range from 20% to 55%. This increases the filling factor of the casting material to spaces between projections 3. Also, sufficient liner bond strength is ensured.

If the second area ratio SB is out of the selected range, the following problems will be caused. If the second area ratio SB is less than 20%, the first area ratio SA will fall below the lower limit value (10%). Thus, the liner bond strength will be significantly reduced. If the second area ratio SB is more than 55%, the filling factor of the casting material in the spaces between the projections 3 will be significantly reduced compared to the case where the second area ratio SB is less than or equal to 55%.

(8) In the cylinder liner 2 of the present embodiment, the projections 3 are formed such that the standard cross-sectional area SD is in the range from 0.2 $mm^2$ to 3.0 $mm^2$. Thus, during the producing process of the cylinder liners 2, the projections 3 are prevented from being damaged. Also, the filling factor of the casting material to spaces between the projections 3 is increased.

If the standard cross-sectional area SD is out of the selected range, the following problems will be caused. If the standard cross-sectional area SD is less than 0.2 $mm^2$, the strength of the projections 3 will be insufficient, and the projections 3 will be easily damaged during the production of the cylinder liner 2. If the standard cross-sectional area SD is more than 3.0 $mm^2$, narrow spaces between the projections 3 will reduce the filing factor of the casting material to spaces between the projections 3.

(9) In the cylinder liner 2 of the present embodiment, the projections 3 (the first areas RA) are formed to be independent from one another on the first reference plane PA. In other words, a cross-section of each projection 3 by a plane containing the contour line representing a height of 0.4 mm from its proximal end is independent from cross-sections of the other projections 3 by the same plane. This increases the filling factor of the casting material to spaces between projections 3. If the projections 3 (the first areas RA) are not independent from one another in the first reference plane PA, narrow spaces between the projections 3 will reduce the filing factor of the casting material to spaces between the projections 3.

(10) In an engine, an increase in the cylinder wall temperature TW causes the cylinder bores to be thermally expanded. Since the cylinder wall temperature TW varies among positions along the axial direction of the cylinder, the amount of deformation of the cylinder bores due to thermal expansion varies along the axial direction. Such variation in deformation amount of the cylinder bores increases the friction of the piston, which degrades the fuel consumption rate.

In the cylinder liner 2 of the present embodiment, the film 5 is not formed on the liner outer circumferential surface 22 of the high temperature liner portion 26, while the film 5 is formed on the liner outer circumferential surface 22 of the low temperature liner portion 27.

Accordingly, the cylinder wall temperature TW of the low temperature liner portion 27 of the engine 1 (broken line in FIG. 6B) surpasses the cylinder wall temperature TW of the low temperature liner portion 27 of the reference engine (solid line in FIG. 6B). On the other hand, the cylinder wall temperature TW of the high temperature liner portion 26 of the engine 1 (broken line in FIG. 6B) is substantially the same as the cylinder wall temperature TW of the high temperature liner portion 26 (solid line in FIG. 6B) of the reference engine.

Therefore, the cylinder wall temperature difference ΔTW, which is the difference between the minimum cylinder wall temperature TWL and the maximum cylinder wall temperature TWH in the engine 1, is reduced. Thus, variation of deformation of each cylinder bore 15 along the axial direction of the cylinder 13 is reduced. Accordingly, the amount of deformation of each cylinder bore 15 is equalized. This reduces the friction of the piston and thus improves the fuel consumption rate.

(11) In the cylinder liner 2 of the present embodiment, the film thickness TP is set to gradually increase from the wall temperature boundary 28 to the liner lower end 24. Accordingly, the thermal conductivity between the cylinder block 11 and the cylinder liner 2 is reduced as it approaches the liner lower end 24. This reduces the variation in the cylinder wall temperature TW along the axial direction of the low temperature liner portion 27.

Modifications of First Embodiment

The above illustrated first embodiment may be modified as shown below.

In the first embodiment, the film 5 is formed such that the film thickness TP is gradually increased from the wall temperature boundary 28 to the liner lower end 24. However, the film thickness TP may be constant in the low temperature liner portion 27. In short, the setting of the film thickness TP may be changed as necessary in a range that does not cause the cylinder wall temperature TW to be greatly different from the appropriate temperature in the entire low temperature liner portion 27.

Second Embodiment

A second embodiment of the present invention will now be described with reference to FIGS. 19 to 21.

The second embodiment is configured by changing the formation of the film 5 in the cylinder liner 2 according to the first embodiment in the following manner. The cylinder liner 2 according to the second embodiment is the same as that of the first embodiment except for the configuration described below.

Formation of Film

Figure 19:
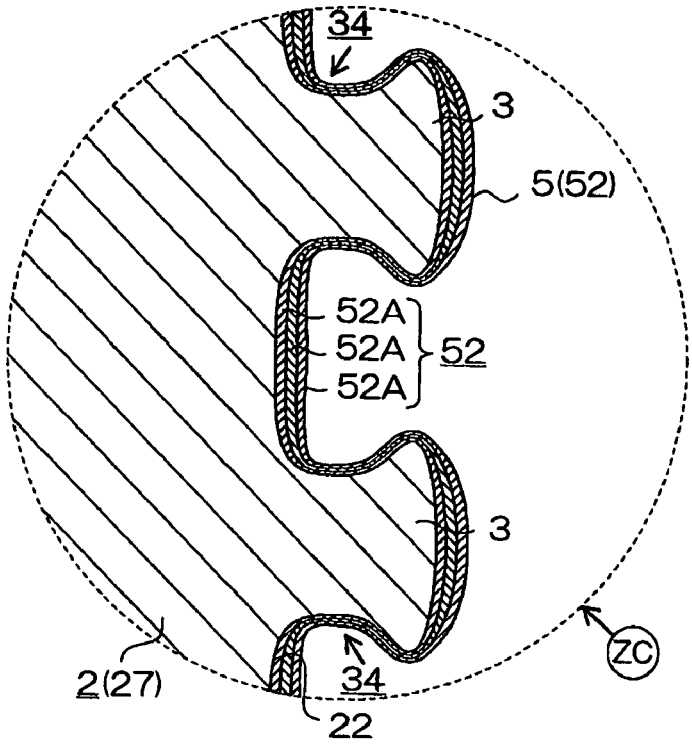
FIG. 19 is an enlarged cross-sectional view of a cylinder liner according to a second embodiment of the present invention, showing encircled part ZC of FIG. 6A.

FIG. 19 is an enlarged view showing encircled part ZC of FIG. 6A. In the cylinder liner 2, a film 5 is formed on a liner outer circumferential surface 22 of a low temperature liner portion 27. The film 5 is formed of a sprayed layer of an iron based material (iron sprayed layer 52). The iron sprayed layer 52 is formed by laminating a plurality of thin sprayed layers 52A. The iron sprayed layer 52 (the thin sprayed layers 52A) contains a number of layers of oxides and pores.

Bonding State of Cylinder Block and Low Temperature Liner Portion

Figure 20:
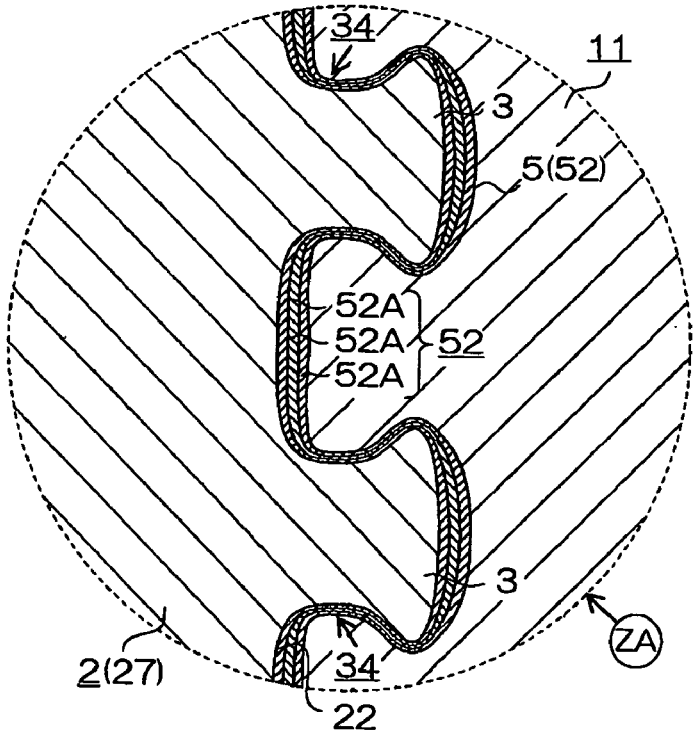
FIG. 20 is an enlarged cross-sectional view of the cylinder liner according to the second embodiment, showing encircled part ZA of FIG. 1.

FIG. 20 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a sprayed layer containing a number of layers of oxides and pores, the cylinder block 11 and the film 5 are mechanically bonded to each other in a state of low thermal conductivity.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Method for Producing Film

The method for forming the film 5 will be described with reference to FIGS. 21A and 21B. In the present embodiment, the film 5 is formed by arc spraying. The film 5 may be formed through the following procedure.

Figure 21A:
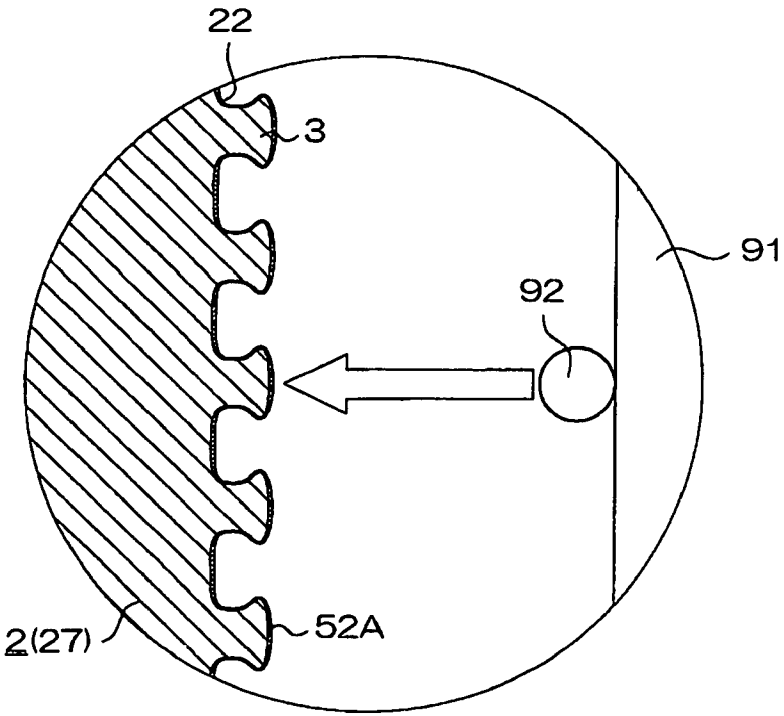
FIGS. 21A and 21B are diagrams showing one example of a procedure for forming a film by arc spraying on the cylinder liner of the second embodiment.

[1] Molten wire 92 is sprayed onto the liner outer circumferential surface 22 by an arc spraying device 91 to form a thin sprayed layer 52A (FIG. 21A).

Figure 21B:
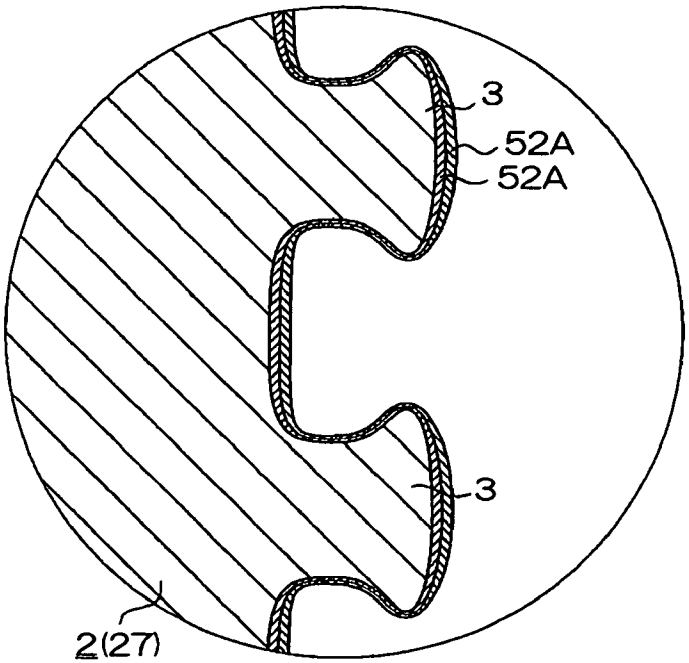

[2] After forming one thin sprayed layer 52A, another thin sprayed layer 52A is formed on the first thin sprayed layer 52A (FIG. 21B).

[3] The process [2] is repeated until the film 5 of a desired thickness is formed.

According to the above producing method, the wire 92 is melt and changed into particles, the surfaces of which are oxidized. Thus, the iron sprayed layer 52 (the thin sprayed layers 52A) contains a number of layers of oxides. This further increases the heat insulation property of the film 5.

In the present embodiment, the diameter of the wire 92 used in the arc spraying is set equal to or greater than 0.8 mm. Therefore, powder of the wire 92 having relatively large particle sizes are sprayed onto the low temperature liner portion 27, and the formed iron sprayed layer 52 includes a number of pores. That is, the film 5 having a high heat insulation property is formed.

If the diameter of the wire 92 is less than 0.8 mm, powder of the wire 92 having small particle sizes are sprayed onto the low temperature liner portion 27. Thus, compared to the case where the diameter of the wire 92 is equal to or greater than 0.8 mm, the number of pores in the iron sprayed layer 52 is significantly reduced.

Advantages of Second Embodiment

In addition to the advantages (1) to (11) in the first embodiment, the cylinder liner 2 of the second embodiment provides the following advantage.

(12) In the cylinder liner 2 of the present embodiment, the iron sprayed layer 52 is formed of a plurality of thin sprayed layers 52A. Accordingly, a number of layers of oxides are formed in the iron sprayed layer 52. Thus, the thermal conductivity between the cylinder block 11 and the low temperature liner portion 27 is further reduced.

Modifications of Second Embodiment

The above illustrated second embodiment may be modified as shown below.

In the second embodiment, the diameter of the wire 92 is set to 0.8 mm when forming the film 5. However, the selected range of the diameter of the wire 92 may be set in the following manner. That is, the selected range of the diameter of the wire 92 may be set to a range from 0.8 mm to 2.4 mm. If the diameter of the wire 92 is set greater than 2.4 mm, the particles of the wire 92 will be large. It is therefore predicted that the strength of the iron sprayed layer 52 will be significantly reduced.

Third Embodiment

A third embodiment of the present invention will now be described with reference to FIGS. 22 and 23.

The third embodiment is configured by changing the formation of the film 5 in the cylinder liner 2 according to the first embodiment in the following manner. The cylinder liner 2 according to the third embodiment is the same as that of the first embodiment except for the configuration described below.

Formation of Film

Figure 22:
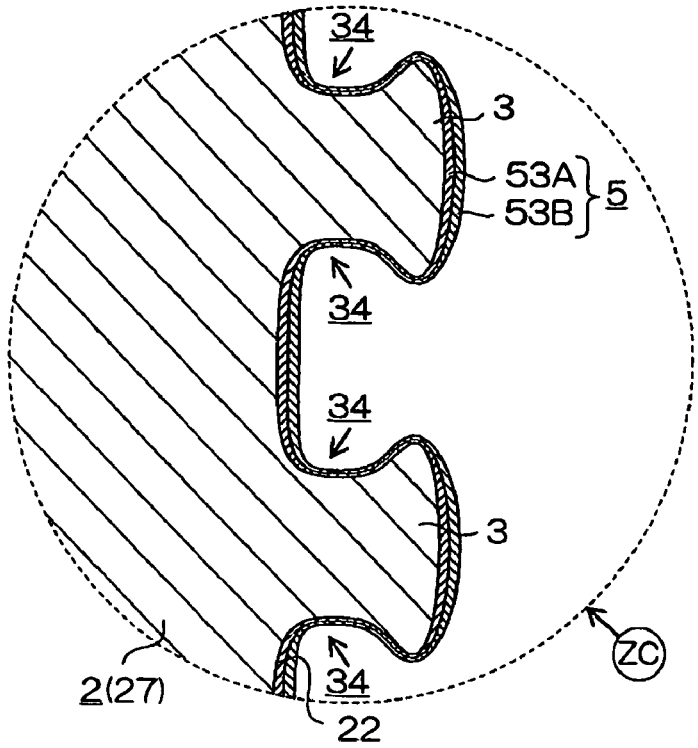
FIG. 22 is an enlarged cross-sectional view of a cylinder liner according to a third embodiment of the present invention, showing encircled part ZC of FIG. 6A.

FIG. 22 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a first sprayed layer 53A formed on the surface of he cylinder liner 2 and a second sprayed layer 53B formed on the surface of the first sprayed layer 53A.

The first sprayed layer 53A is formed of a ceramic material (alumina or zirconia). As the material for the first sprayed layer 53A, a material that reduces the thermal conductivity between the cylinder block 11 and the low temperature liner portion 27 may be used.

The second sprayed layer 53B is formed of an aluminum alloy (Al—Si alloy or Al—Cu alloy). As the material for the second sprayed layer 53B, a material having a high bonding property with the cylinder block 11 may be used.

Bonding State of Cylinder Block and Low Temperature Liner Portion

Figure 23:
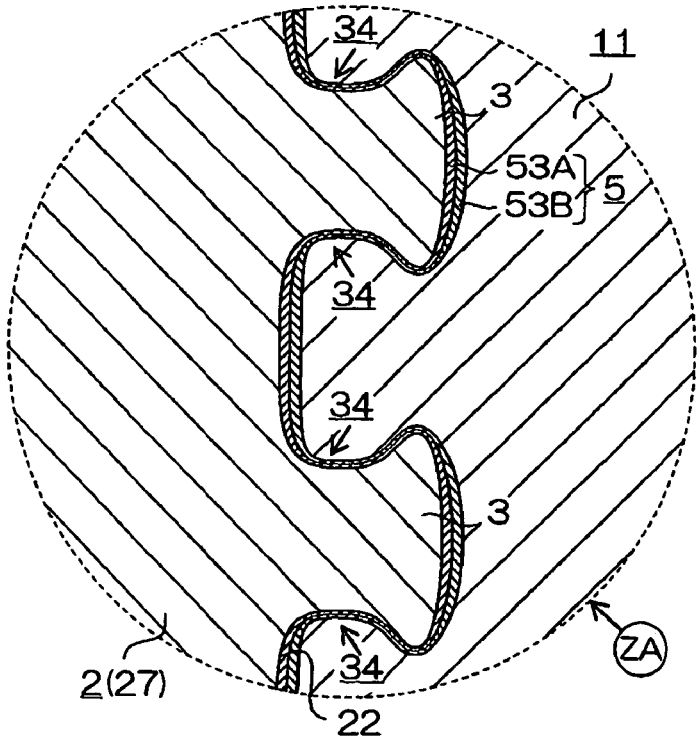
FIG. 23 is an enlarged cross-sectional view of the cylinder liner according to the third embodiment, showing encircled part ZA of FIG. 1.

FIG. 23 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a ceramic material, which has a lower thermal conductivity than that of the cylinder block 11, the cylinder block 11 and the film 5 are mechanically bonded to each other in a state of a low thermal conductivity.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Since the film 5 includes the second sprayed layer 53B having a high boding property with the cylinder block 11, the bond strength between the film 5 and the cylinder block 11 is increased compared to a case where the film 5 is formed only of the first sprayed layer 53A.

Method for Forming Film

In the present embodiment, the film 5 is formed by plasma spraying. The film 5 may be formed through the following procedure.

[1] Form the first sprayed layer 53A on the low temperature liner portion 27 using a plasma spraying device.

[2] Form the second sprayed layer 53B using the plasma spraying device after forming the first sprayed layer 53A.

Advantages of Third Embodiment

In addition to the advantages (1) to (11) in the first embodiment, the cylinder liner 2 of the third embodiment provides the following advantage.

(13) In the cylinder liner 2 of the present embodiment, the film 5 is formed of the first sprayed layer 53A and the second sprayed layer 53B. Thus, while ensuring the heat insulation property of the film 5 by the first sprayed layer 53A, the second sprayed layer 53B improves the bonding property between the cylinder block 11 and the film 5.

Fourth Embodiment

A fourth embodiment of the present invention will now be described with reference to FIGS. 24 and 25.

The fourth embodiment is configured by changing the formation of the film 5 in the cylinder liner 2 according to the first embodiment in the following manner. The cylinder liner 2 according to the fourth embodiment is the same as that of the first embodiment except for the configuration described below.

Formation of Film

Figure 24:
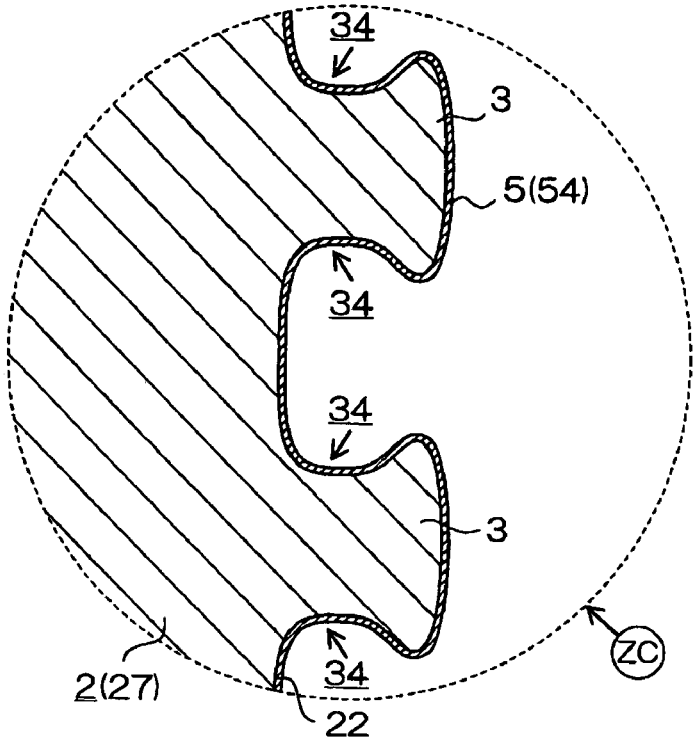
FIG. 24 is an enlarged cross-sectional view of a cylinder liner according to a fourth embodiment of the present invention, showing encircled part ZC of FIG. 6A.

FIG. 24 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of an oxide layer 54.

Bonding State of Cylinder Block and Low Temperature Liner Portion

Figure 25:
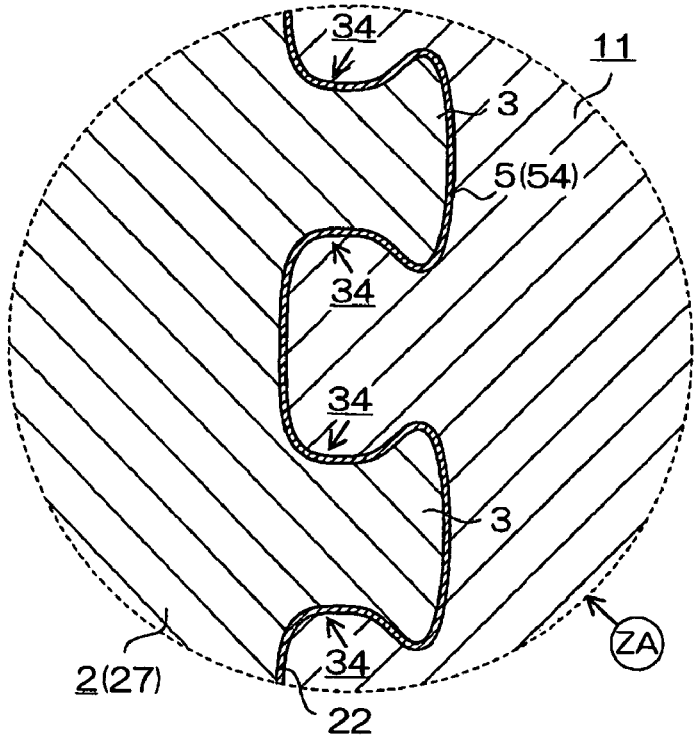
FIG. 25 is an enlarged cross-sectional view of the cylinder liner according to the fourth embodiment, showing encircled part ZA of FIG. 1.

FIG. 25 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of oxides, the cylinder block 11 and the film 5 are mechanically bonded to each other in a state of low thermal conductivity.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Method for Producing Film

In the present embodiment, the film 5 is formed by high-frequency heating. The film 5 may be formed through the following procedure.

[1] The low temperature liner portion 27 is heated by a high frequency heating device.

[2] Heating is continued until the oxide layer 54 of a predetermined thickness is formed on the liner outer circumferential surface 22.

According to this method, heating of the low temperature liner portion 27 melts the distal end 32 of each projection 3. As a result, an oxide layer 54 is thicker at the distal end 32 than in other portions. Accordingly, the heat insulation property about the distal end 32 of the projection 3 is improved. Also, the film 5 is formed to have a sufficient thickness at the constriction 33 of each projection 3. Therefore, the heat insulation property about the constriction 33 is further improved.

Advantages of Fourth Embodiment

In addition to the advantages (1) to (11) in the fourth embodiment, the cylinder liner 2 of the third embodiment provides the following advantage.

(14) In the cylinder liner 2 of the present embodiment, the film 5 is formed by heating the cylinder liner 2. This improves the heat insulation property about the constriction 33. Also since no additional material is required to form the film 5 is needed, effort and costs for material control are reduced.

Fifth Embodiment

A fifth embodiment of the present invention will now be described with reference to FIGS. 26 and 27.

The fifth embodiment is configured by changing the formation of the film 5 in the cylinder liner 2 according to the first embodiment in the following manner. The cylinder liner 2 according to the fifth embodiment is the same as that of the first embodiment except for the configuration described below.

Formation of Film

Figure 26:
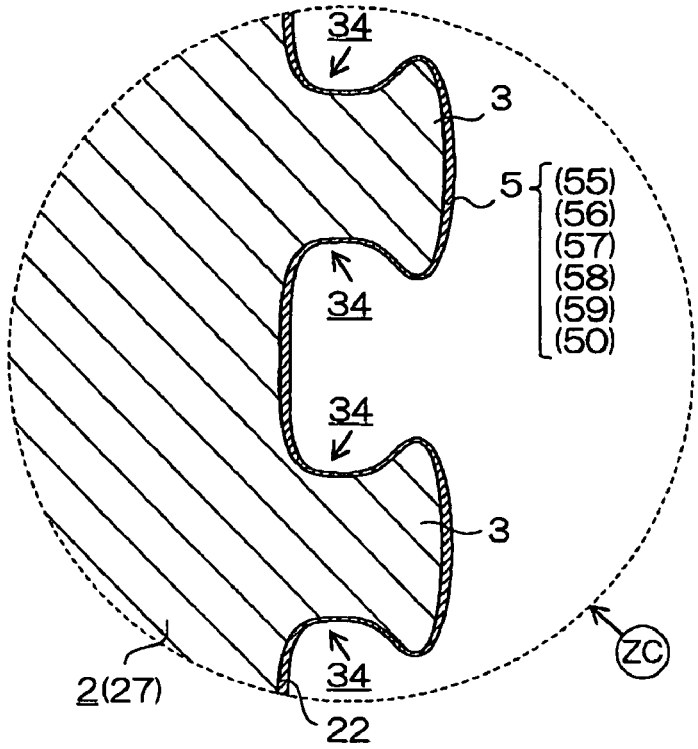
FIG. 26 is an enlarged cross-sectional view of a cylinder liner according to fifth to tenth embodiment of the present invention, showing encircled part ZC of FIG. 6A.

FIG. 26 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a mold release agent layer 55, which is a layer of mold release agent for die casting.

When forming the mold release agent layer 55, for example, the following mold release agents may be used.

[1] A mold release agent obtained by compounding vermiculite, Hitasol, and water glass.

[2] A mold release agent obtained by compounding a liquid material, a major component of which is silicon, and water glass.

Bonding State of Cylinder Block and Low Temperature Liner Portion

Figure 27:
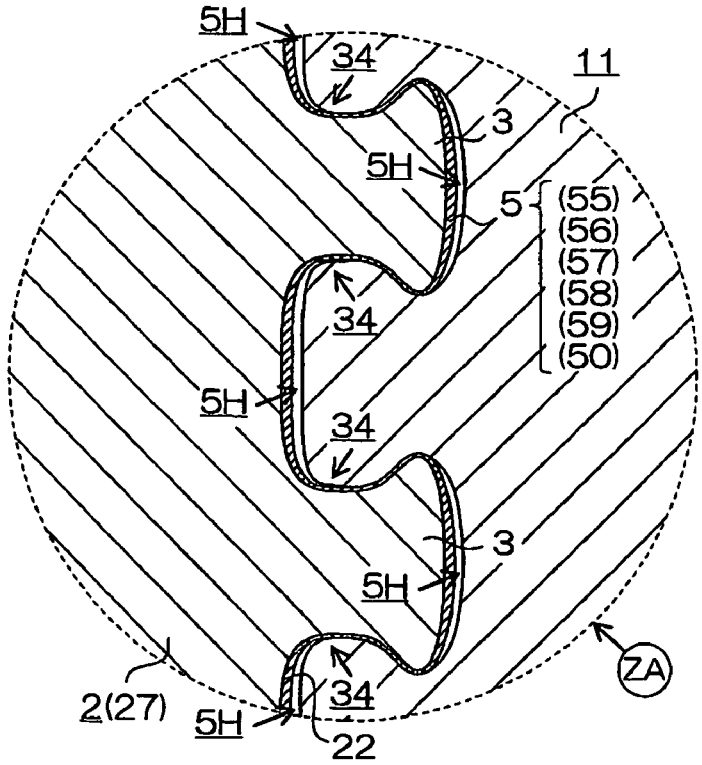
FIG. 27 is an enlarged cross-sectional view of the cylinder liner according to the fifth to tenth embodiment, showing encircled part ZA of FIG. 1.

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a mold release agent, which has a low adhesion with the cylinder block 11, the cylinder block 11 and the film 5 are bonded to each other with gaps 5H. When producing the cylinder block 11, the casting material is solidified in a state where sufficient adhesion between the casting material and the mold release agent layer 55 is not established at several portions. Accordingly, the gaps 5H are created between the cylinder block 11 and the mold release agent layer 55.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Advantages of Fifth Embodiment

In addition to the advantages (1) to (11) in the first embodiment, the cylinder liner 2 of the fifth embodiment provides the following advantage.

(15) In the cylinder liner 2 of the present embodiment, the film 5 is formed by using a mold release agent for die casting. Therefore, when forming the film 5, the mold release agent for die casting that is used for producing the cylinder block 11 or the material for the agent can be used. Thus, the number of producing steps and costs are reduced.

Sixth Embodiment

A sixth embodiment of the present invention will now be described with reference to FIGS. 26 and 27.

The sixth embodiment is configured by changing the formation of the film 5 in the cylinder liner 2 according to the first embodiment in the following manner. The cylinder liner 2 according to the sixth embodiment is the same as that of the first embodiment except for the configuration described below.

Formation of Film

FIG. 26 is an enlarged view showing encircled part ZC of FIG. 6A. In the cylinder liner 2, a film 5 is formed on a liner outer circumferential surface 22 of a low temperature liner portion 27. The film 5 is formed of a mold wash layer 56, which is a layer of mold wash for the centrifugal casting mold.

When forming the mold wash layer 56, for example, the following mold washes may be used.

[1] A mold wash containing diatomaceous earth as a major component.

[2] A mold wash containing graphite as a major component.

Bonding State of Cylinder Block and Low Temperature Liner Portion

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a mold wash, which has a low adhesion with the cylinder block 11, the cylinder block 11 and the film 5 are bonded to each other with gaps 5H. When producing the cylinder block 11, the casting material is solidified in a state where sufficient adhesion between the casting material and the mold wash layer 56 is not established at several portions. Accordingly, the gaps 5H are created between the cylinder block 11 and the mold wash layer 56.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Advantages of Sixth Embodiment

In addition to the advantages (1) to (11) in the first embodiment, the cylinder liner 2 of the sixth embodiment provides the following advantage.

(16) In the cylinder liner 2 of the present embodiment, the film 5 is formed by using a mold wash for centrifugal casting. Therefore, when forming the film 5, the mold wash for centrifugal casting that is used for producing the cylinder block 11 or the material for the mold was can be used. Thus, the number of producing steps and costs are reduced.

Seventh Embodiment

A seventh embodiment of the present invention will now be described with reference to FIGS. 26 and 27.

The seventh embodiment is configured by changing the formation of the film 5 in the cylinder liner 2 according to the first embodiment in the following manner. The cylinder liner 2 according to the seventh embodiment is the same as that of the first embodiment except for the configuration described below.

Formation of Film

FIG. 26 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a low adhesion agent layer 57. The low adhesion agent refers to a liquid material prepared using a material having a low adhesion with the cylinder block 11.

When forming the low adhesion agent layer 57, for example, the following low adhesion agents may be used.

[1] A low adhesion agents obtained by compounding graphite, water glass, and water.

[2] A low adhesion agent obtained by compounding boron nitride and water glass.

Bonding State of Cylinder Block and Low Temperature Liner Portion

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a low adhesion agent, which has a low adhesion with the cylinder block 11, the cylinder block 11 and the film 5 are bonded to each other with gaps 5H. When producing the cylinder block 11, the casting material is solidified in a state where sufficient adhesion between the casting material and the low adhesion agent layer 57 is not established at several portions. Accordingly, the gaps 5H are created between the cylinder block 11 and the low adhesion agent layer 57.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Method for Producing Film

In the present embodiment, the film 5 is formed by coating and drying the low adhesion agent. The film 5 may be formed through the following procedure.

[1] The cylinder liner 2 is placed for a predetermined period in a furnace that is heated to a predetermined temperature so as to be preheated.

[2] The cylinder liner 2 is immersed in a liquid low adhesion agent in a container so that the liner outer circumferential surface 22 is coated with the low adhesion agent.

[3] After step [2], the cylinder liner 2 is placed in the furnace used in step [1] so that the low adhesion agent is dried.

[4] Steps [1] to [3] are repeated until the low adhesion agent layer 57, which is formed through drying, has a predetermined thickness.

Advantages of Seventh Embodiment

The cylinder liner 2 according to the seventh embodiment provides advantages similar to the advantages (1) to (11) in the first embodiment.

Modifications of Seventh Embodiment

The above illustrated seventh embodiment may be modified as shown below.

As the low adhesive agent, the following agents may be used.

(a) A low adhesion agent obtained by compounding graphite and organic solvent.

(b) A low adhesion agent obtained by compounding graphite and water.

(c) A low adhesion agent having boron nitride and inorganic binder as major components, or a low adhesion agent having boron nitride and organic binder as major components.

Eighth Embodiment

An eighth embodiment of the present invention will now be described with reference to FIGS. 26 and 27.

The eighth embodiment is configured by changing the formation of the film 5 in the cylinder liner 2 according to the first embodiment in the following manner. The cylinder liner 2 according to the eighth embodiment is the same as that of the first embodiment except for the configuration described below.

Formation of Film

FIG. 26 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a metallic paint layer 58.

Bonding State of Cylinder Block and Low Temperature Liner Portion

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a metallic paint, which has a low adhesion with the cylinder block 11, the cylinder block 11 and the film 5 are bonded to each other with gaps 5H. When producing the cylinder block 11, the casting material is solidified in a state where sufficient adhesion between the casting material and the metallic paint layer 58 is not established at several portions. Accordingly, the gaps 5H are created between the cylinder block 11 and the metallic paint layer 58.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Advantages of Eighth Embodiment

The cylinder liner 2 according to the eighth embodiment provides advantages similar to the advantages (1) to (11) in the first embodiment.

Ninth Embodiment

A ninth embodiment of the present invention will now be described with reference to FIGS. 26 and 27.

The ninth embodiment is configured by changing the formation of the film 5 in the cylinder liner 2 according to the first embodiment in the following manner. The cylinder liner 2 according to the ninth embodiment is the same as that of the first embodiment except for the configuration described below.

Formation of Film

FIG. 26 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a high-temperature resin layer 59.

Bonding State of Cylinder Block and Low Temperature Liner Portion

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a high-temperature resin, which has a low adhesion with the cylinder block 11, the cylinder block 11 and the film 5 are bonded to each other with gaps 5H. When producing the cylinder block 11, the casting material is solidified in a state where sufficient adhesion between the casting material and the high-temperature resin layer 59 is not established at several portions. Accordingly, the gaps 5H are created between the cylinder block 11 and the high-temperature resin layer 59.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Advantages of Ninth Embodiment

The cylinder liner 2 according to the ninth embodiment provides advantages similar to the advantages (1) to (11) in the first embodiment.

Tenth Embodiment

A tenth embodiment of the present invention will now be described with reference to FIGS. 26 and 27.

The tenth embodiment is configured by changing the formation of the film 5 in the cylinder liner 2 according to the first embodiment in the following manner. The cylinder liner 2 according to the tenth embodiment is the same as that of the first embodiment except for the configuration described below.

Formation of Film

FIG. 26 is an enlarged view showing encircled part ZC of FIG. 6A. In the cylinder liner 2, a film 5 is formed on a liner outer circumferential surface 22 of a low temperature liner portion 27 in the cylinder liner 2. The film 5 is formed of a chemical conversion treatment layer 50, which is a layer formed through chemical conversion treatment.

As the chemical conversion treatment layer 50, the following layers maybe formed.

[1] A chemical conversion treatment layer of phosphate.

[2] A chemical conversion treatment layer of ferrosoferric oxide.

Bonding State of Cylinder Block and Low Temperature Liner Portion

FIG. 27 is a cross-sectional view of encircled part ZA of FIG. 1 and shows the bonding state between the cylinder block 11 and the low temperature liner portion 27.

In the engine 1, the cylinder block 11 is bonded to the low temperature liner portion 27 in a state where the cylinder block 11 is engaged with the projections 3. The cylinder block 11 and the low temperature liner portion 27 are bonded to each other with the film 5 in between.

Since the film 5 is formed of a chemical conversion treatment layer, which has a low adhesion with the cylinder block 11, the cylinder block 11 and the film 5 are bonded to each other with gaps 5H. When producing the cylinder block 11, the casting material is solidified in a state where sufficient adhesion between the casting material and the chemical conversion treatment layer 50 is not established at several portions. Accordingly, the gaps 5H are created between the cylinder block 11 and the chemical conversion treatment layer 50.

In the engine 1, since the cylinder block 11 and the low temperature liner portion 27 are bonded to each other in this state, the advantages (A) and (B) in "[1] Bonding State of Low Temperature Liner Portion" of the first embodiment are obtained.

Also, since the film 5 is formed by a chemical conversion treatment, the film 5 has a sufficient thickness at the constriction 33 of the projection 3. This allows the gaps 5H to be easily created about the constriction 33 of the cylinder block 11. Therefore, the heat insulation property about the constriction 33 is improved.

Advantages of Tenth Embodiment

In addition to the advantages (1) to (11) in the first embodiment, the cylinder liner 2 of the tenth embodiment provides the following advantage.

(17) In the cylinder liner 2 of the present embodiment, the film 5 is formed by chemical conversion treatment. This improves the heat insulation property about the constriction 33.

Other Embodiments

The above embodiments may be modified as follows.

In the above illustrated embodiments, the selected ranges of the first area ratio SA and the second area ratio SB are set be in the selected ranges shown in Table 1. However, the selected ranges may be changed as shown below.

The first area ratio SA: 10% to 30%

The second area ratio SB: 20% to 45%

This setting increases the liner bond strength and the filling factor of the casting material to the spaces between the projections 3.

In the above embodiments, the selected range of the standard projection height HP is set to a range from 0.5 mm to 1.0 mm. However, the selected range may be changed as shown below. That is, the selected range of the standard projection height HP may be set to a range from 0.5 mm to 1.5 mm.

In the above embodiments, the film 5 is not formed on the liner outer circumferential surface 22 of the high temperature liner portion 26, while the film 5 is formed on the liner outer circumferential surface 22 of the low temperature liner portion 27. This configuration may be modified as follows. That is, the film 5 may be formed on the liner outer circumferential surface 22 of both of the low temperature liner portion 27 and the high temperature liner portion 26. This configuration reliably prevents the cylinder wall temperature TW at some locations from being excessively lowered.

In the above embodiments, the film 5 is formed along the entire circumference of the cylinder liner 2. However, the position of the film 5 may be changed as shown below. That is, with respect to the direction along which the cylinders 13 are arranged, the film 5 may be omitted from sections of the liner outer circumferential surfaces 22 that face the adjacent cylinder bores 15. In other words, the films 5 may be formed in sections except for sections of the liner outer circumferential surfaces 2 that face the liner outer circumferential surfaces 2 of the adjacent cylinder liners 2 with respect to the arrangement direction of the cylinders 13. This configuration provides the following advantages (i) and (ii).

(i) Heat from each adjacent pair of the cylinders 13 is likely to be confined in a section between the corresponding cylinder bores 15. Thus, the cylinder wall temperature TW in this section is likely to be higher than that in the sections other than the sections between the cylinder bores 15. Therefore, the above described modification of the formation of the film 5 prevents the cylinder wall temperature. TW in a section facing the adjacent the cylinder bores 15 with respect to the circumferential direction of the cylinders 13 is prevented from excessively increased.

(ii) In each cylinder 13, since the cylinder wall temperature TW varies along the circumferential direction, the amount of deformation of the cylinder bore 15 varies along the circumferential direction. Such variation in deformation amount of the cylinder bore 15 increases the friction of the piston, which degrades the fuel consumption rate. When the above configuration of the formation of the film 5 is adopted, the thermal conductivity is lowered in sections other than the sections facing the adjacent cylinder bores 15 with respect to the circumferential direction of the cylinder 13. On the other hand, the thermal conductivity of the sections facing the adjacent cylinder bores 15 is the same as that of conventional engines. This reduces the difference between the cylinder wall temperature TW in the sections other than the sections facing the adjacent cylinder bores 15 and the cylinder wall temperature TW in the sections facing the adjacent the cylinder bores 15. Accordingly, variation of deformation of each cylinder bore 15 along the circumferential direction is reduced (deformation amount is equalized). This reduces the friction of the piston and thus improves the fuel consumption rate.

The method for forming the film 5 is not limited to the methods shown in the above embodiments (spraying, coating, resin coating, and chemical conversion treatment). Any other method may be applied as necessary.

The configuration of the formation of the film 5 according to the above embodiments may be modified as shown below.

That is, the film 5 may be formed of any material as long as at least one of the following conditions (A) and (B) is met.

(A) The thermal conductivity of the film 5 is smaller than that of the cylinder liner 2.

(B) The thermal conductivity of the film 5 is smaller than that of the cylinder block 11.

In the above embodiments, the film 5 is formed on the cylinder liner 2 with the projections 3 the related parameters of which are in the selected ranges of Table 1. However, the film 5 may be formed on any cylinder liner as long as the projections 3 are formed on it.

In the above embodiments, the film 5 is formed on the cylinder liner 2 on which the projections 3 are formed. However, the film 5 may be formed on a cylinder liner on which projections without constrictions are formed.

In the above embodiments, the film 5 is formed on the cylinder liner 2 on which the projections 3 are formed. However, the film 5 may be formed on a cylinder liner on which no projections are formed.

In the above embodiment, the cylinder liner of the present embodiment is applied to an engine made of an aluminum alloy. However, the cylinder liner of the present invention may be applied to an engine made of, for example, a magnesium alloy. In short, the cylinder liner of the present invention may be applied to any engine that has a cylinder liner. Even in such case, the advantages similar to those of the above embodiments are obtained if the invention is embodied in a manner similar to the above embodiments.

The invention claimed is:

1. A cylinder liner for insert casting used in a cylinder block, comprising:

first portion corresponding to a high temperature region;

a second portion corresponding to a low temperature region; and a film formed on an outer circumferential surface of the second portion, the film being made of material that reduces the adhesion between the cylinder liner and the cylinder block so that gaps are formed between the cylinder block and the cylinder liner, thereby reducing a thermal conductivity between the cylinder block and the cylinder liner;

wherein the cylinder block and the cylinder liner are bonded to each other from a top surface of the cylinder to a bottom surface of the cylinder, and wherein the film is made of a material that remains bonded to the second portion of the cylinder liner.

2. A cylinder liner for insert casting used in a cylinder block, comprising:

first portion corresponding to a high temperature region;

a second portion corresponding to a low temperature region; and a film formed on an outer circumferential surface of the second portion, the film being made of a mold release agent that reduces the adhesion between the cylinder liner and the cylinder block so that gaps are formed between the cylinder block and the cylinder liner, thereby reducing a thermal conductivity between the cylinder block and the cylinder liner;

wherein the cylinder block and the cylinder liner are bonded to each other from a top surface of the cylinder to a bottom surface of the cylinder, and wherein the film is made of a material that remains bonded to the second portion of the cylinder liner.

3. A cylinder liner for insert casting used in a cylinder block, comprising:

first portion corresponding to a high temperature region;

a second portion corresponding to a low temperature region; and a film formed on an outer circumferential surface of the second portion, the film being made of a low adhesion agent containing graphite as a major component that reduces the adhesion between the cylinder liner and the cylinder block so that gaps are formed between the cylinder block and the cylinder liner, thereby reducing a thermal conductivity between the cylinder block and the cylinder liner;

wherein the cylinder block and the cylinder liner are bonded to each other from a top surface of the cylinder to a bottom surface of the cylinder, and wherein the film is made of a material that remains bonded to the second portion of the cylinder liner.

4. A cylinder liner for insert casting used in a cylinder block, comprising:

first portion corresponding to a high temperature region;

a second portion corresponding to a low temperature region; and a film formed on an outer circumferential surface of the second portion, the film being made of a high temperature resin as a major component that reduces the adhesion between the cylinder liner and the cylinder block so that gaps are formed between the cylinder block and the cylinder liner, thereby reducing a thermal conductivity between the cylinder block and the cylinder liner;

wherein the cylinder block and the cylinder liner are bonded to each other from a top surface of the cylinder to a bottom surface of the cylinder, and wherein the film is made of a material that remains bonded to the second portion of the cylinder liner.

5. A cylinder liner for insert casting used in a cylinder block, comprising:

first portion corresponding to a high temperature region;

a second portion corresponding to a low temperature region; and a film formed on an outer circumferential surface of the second portion, the film being made of a chemical conversion treatment layer as a major component that reduces the adhesion between the cylinder liner and the cylinder block so that gaps are formed between the cylinder block and the cylinder liner, thereby reducing a thermal conductivity between the cylinder block and the cylinder liner;

wherein the cylinder block and the cylinder liner are bonded to each other from a top surface of the cylinder to a bottom surface of the cylinder, and wherein the film is made of a material that remains bonded to the second portion of the cylinder liner.

6. The cylinder liner according to claim 1, wherein the film extends from a middle portion to a lower end of the cylinder liner with respect to an axial direction of the cylinder liner.

7. The cylinder liner according to claim 6, wherein the thickness of the film increases as it gets closer to the lower end of the cylinder liner along the axial direction of the cylinder liner.

8. The cylinder liner according to claim 1, wherein the film extends from an upper end to a lower end of the cylinder liner with respect to an axial direction of the cylinder liner.

9. The cylinder liner according to claim 8, wherein the thickness of the film increases as it gets closer to the lower end of the cylinder liner along the axial direction of the cylinder liner.

10. The cylinder liner according to claim 1, wherein the cylinder block has a plurality of cylinder bores, the cylinder liner being located in one of the cylinder bores, and wherein the low thermal conductive film is formed on the outer circumferential surface except for sections that face the adjacent cylinder bores.

11. The cylinder liner according to claim 1, wherein the outer circumferential surface has a plurality of projections each having a constricted shape.

12. A cylinder liner for insert casting used in a cylinder block, comprising:

first portion corresponding to a high temperature region;

a second portion corresponding to a low temperature region; and a film formed on an outer circumferential surface of the second portion, the outer circumferential surface having a plurality of projections, each projection having a constricted shape, the film having a thermal conductivity lower than that of at least one of the cylinder block and the cylinder liner, and the film adapted to reduce a thermal conductivity between the cylinder block and the cylinder liner, wherein the cylinder block and the cylinder liner are bonded to each other from a top surface of the cylinder to a bottom surface of the cylinder, and wherein the film is made of a material that remains bonded to the second portion of the cylinder liner.

13. The cylinder liner according to claim 12, wherein the film is formed of a sprayed layer of a ceramic material.

14. The cylinder liner according to claim 12, wherein the film extends from a middle portion to a lower end of the cylinder liner with respect to an axial direction of the cylinder liner.

15. The cylinder liner according to claim 14, wherein the thickness of the film increases as it gets closer to the lower end of the cylinder liner along the axial direction of the cylinder liner.

16. The cylinder liner according to claim 12, wherein the film extends from an upper end to a lower end of the cylinder liner with respect to an axial direction of the cylinder liner.

17. The cylinder liner according to claim 16, wherein the thickness of the film increases as it gets closer to the lower end of the cylinder liner along the axial direction of the cylinder liner.

18. The cylinder liner according to claim 12, wherein the cylinder block has a plurality of cylinder bores, the cylinder liner being located in one of the cylinder bores, and wherein the low thermal conductive film is formed on the outer circumferential surface except for sections that face the adjacent cylinder bores.

19. The cylinder liner according to claim 12, wherein the number of the projections is five to sixty per 1 cm2 of the outer circumferential surface of the cylinder liner.

20. The cylinder liner according to claim 12, wherein the height of each projection is 0.5 to 1.0 mm.

21. The cylinder liner according to claim 12, wherein, in a contour diagram of the outer circumferential surface of the cylinder liner obtained by a three-dimensional laser measuring device, the ratio of the total area of regions each surrounded by a contour line representing a height of 0.4 mm to the area of the entire contour diagram is equal to or more than 10%.

22. The cylinder liner according to claim 12, wherein, in a contour diagram of the outer circumferential surface of the cylinder liner obtained by a three-dimensional laser measuring device, the ratio of the total area of regions each surrounded by a contour line representing a height of 0.2 mm to the area of the entire contour diagram is equal to or less than 55%.

23. The cylinder liner according to claim 12, wherein, in a contour diagram of the outer circumferential surface of the cylinder liner obtained by a three-dimensional laser measuring device, the ratio of the total area of regions each surrounded by a contour line representing a height of 0.4 mm to the area of the entire contour diagram is 10% to 50%.

24. The cylinder liner according to claim 12, wherein, in a contour diagram of the outer circumferential surface of the cylinder liner obtained by a three-dimensional laser measuring device, the ratio of the total area of regions each surrounded by a contour line representing a height of 0.2 mm to the area of the entire contour diagram is 20to 55%.

25. The cylinder liner according to claim 12, wherein, in a contour diagram of the outer circumferential surface of the cylinder liner obtained by a three-dimensional laser measuring device, the area of each region surrounded by a contour line representing a height of 0.4 mm is 0.2 to 3.0 $mm^2$.

26. The cylinder liner according to claim 12, wherein a cross-section of each projection by a plane containing the contour line representing a height of 0.4 mm from the proximal end of the projection is independent from cross-sections of the other projections by the same plane.

27. A cylinder liner for insert casting used in a cylinder block, comprising:

first portion corresponding to a high temperature region;

a second portion corresponding to a low temperature region; and a film formed on an outer circumferential surface of the second portion extending from a middle portion to a lower end of the cylinder liner with respect to an axial direction of the cylinder liner, the film having a thermal conductivity lower than that of at least one of the cylinder block and the cylinder liner, and the film adapted to reduce a thermal conductivity between the cylinder block, wherein the cylinder block and the cylinder liner are bonded to each other from a top surface of the cylinder to a bottom surface of the cylinder, and wherein the film is made of a material that remains bonded to the second portion of the cylinder liner.

* * * * *